US012071202B2

(12) United States Patent
Morgan et al.

(10) Patent No.: US 12,071,202 B2
(45) Date of Patent: Aug. 27, 2024

(54) BIMINI AND WATERCRAFT HAVING A BIMINI

(71) Applicant: BOMBARDIER RECREATIONAL PRODUCTS INC., Valcourt (CA)

(72) Inventors: Garrett Morgan, Valcourt (CA); Kevin Giguere, Racine (CA); Guillaume Doyon, Sherbrooke (CA); Antoine Labbe, Sherbrooke (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 363 days.

(21) Appl. No.: 17/535,859

(22) Filed: Nov. 26, 2021

(65) Prior Publication Data

US 2022/0161896 A1 May 26, 2022

Related U.S. Application Data

(60) Provisional application No. 63/118,708, filed on Nov. 26, 2020.

(51) Int. Cl.
*B63B 17/02* (2006.01)

(52) U.S. Cl.
CPC ..... *B63B 17/02* (2013.01); *B63B 2017/026* (2013.01)

(58) Field of Classification Search
CPC .... B63B 17/00; B63B 17/02; B63B 2017/026
USPC ..... 114/343, 361, 364
See application file for complete search history.

(56) References Cited

U.S. PATENT DOCUMENTS

| | | | | |
|---|---|---|---|---|
| 4,683,900 | A | 8/1987 | Carmichael | |
| 5,520,139 | A | 5/1996 | King et al. | |
| 5,697,320 | A | 12/1997 | Murray | |
| 6,983,716 | B1 | 1/2006 | Ankney et al. | |
| 7,107,926 | B2 * | 9/2006 | Fishburn | B63B 17/02 114/361 |
| 7,571,691 | B2 * | 8/2009 | Russikoff | B63B 17/02 114/361 |
| 7,921,797 | B2 | 4/2011 | James | |
| 7,950,342 | B2 | 5/2011 | Russikoff | |
| 8,056,495 | B2 | 11/2011 | Lemons | |
| 9,027,500 | B2 * | 5/2015 | Williams | B63B 17/02 114/361 |
| 9,096,291 | B2 * | 8/2015 | Perosino | F16B 2/185 |
| 9,815,525 | B2 | 11/2017 | Hough | |
| 9,849,939 | B2 | 12/2017 | Hough et al. | |
| 10,286,982 | B2 * | 5/2019 | Sheedy | B63B 17/02 |

(Continued)

*Primary Examiner* — Daniel V Venne
(74) *Attorney, Agent, or Firm* — BCF LLP

(57) ABSTRACT

A bimini has a collapsible frame having a first support and a second support pivotable about a first pivot axis, a top, a tensioner having a first arm pivotally connected to the first support about a second pivot axis and a second arm pivotally connected to the second support about a third pivot axis and to the first arm about a fourth pivot axis, and a tension adjuster for adjusting a distance between the second and third pivot axes. The tensioner has an unlocked position where the fourth pivot axis is on a first side of a plane containing the second and third pivot axes, and a locked position where the fourth pivot axis is on a second side of the plane. In the locked position, the collapsible frame is not movable from an extended configuration and to a collapsed configuration. A watercraft having the bimini is also disclosed.

20 Claims, 19 Drawing Sheets

(56) References Cited

U.S. PATENT DOCUMENTS

| | | | | |
|---|---|---|---|---|
| 10,472,022 | B1 * | 11/2019 | Pollen | E04H 15/06 |
| 10,513,314 | B2 | 12/2019 | Parniske et al. | |
| 10,599,711 | B1 * | 3/2020 | Malpani | G06F 16/583 |
| 11,465,714 | B2 * | 10/2022 | Mazzarelli | E04H 15/06 |
| 11,498,646 | B1 * | 11/2022 | Hager | B63B 17/02 |
| 11,667,353 | B2 * | 6/2023 | Ward | B63B 17/02 114/361 |
| 11,858,591 | B2 * | 1/2024 | Ekern | B63B 17/02 |

* cited by examiner

BIMINI AND WATERCRAFT HAVING A BIMINI

CROSS-REFERENCE TO RELATED APPLICATION

The present application claims priority to U.S. Provisional Patent Application No. 63/118,708, filed Nov. 26, 2020 entitled "Bimini and Watercraft Having a Bimini", which is incorporated by reference herein in its entirety.

TECHNOLOGICAL FIELD

The present technology relates to biminis and watercraft having a bimini.

BACKGROUND

Some watercraft have biminis connected thereto to provide shelter from sun and/or rain. Typically, biminis have a collapsible frame to which a flexible panel is connected.

Flexible panels are usually kept under tension to remove slack present therein. Since the flexible panels can stretch and deform over time and variations can occur in mechanical parts of the frames, biminis are generally adjustable so that the flexible panels remain taut. Conventionally, the flexible panels are kept taut by biasing the biminis toward an extended configuration by tension, typically in the form of straps, by hydraulic actuators, by electrical actuators or manual actuators.

However, loose straps when the bimini is not in the extended configuration can be inconvenient and awkward to deal with, while hydraulic, electrical and manual actuators can be expensive and can take up valuable space on the watercraft.

In view of the foregoing, there is a desire for a bimini that addresses at least some of these drawbacks.

SUMMARY

It is an object of the present technology to ameliorate at least some of the inconveniences present in the prior art.

According to one aspect of the present technology, there is provided a bimini including a collapsible frame, a top, a tensioner and a tension adjuster. The collapsible frame is selectively movable between a collapsed configuration and an extended configuration. The collapsible frame includes a first support and a second support. The second support is selectively pivotable relative to the first support about a first pivot axis. The top extends between the first support and the second support. The tensioner is connected between the first support and the second support. The tensioner has at least a locked position and an unlocked position. The tensioner includes a first arm and a second arm. The first arm is pivotally connected to the first support about a second pivot axis. The second arm is pivotally connected to the second support about a third pivot axis and pivotally connected to the first arm about a fourth pivot axis. In the extended configuration of the collapsible frame and in the unlocked position of the tensioner, the fourth pivot axis is on a first side of a plane containing the second and third pivot axes, and the second support is pivotable relative to the first support about the first pivot axis. In the extended configuration of the collapsible frame and in the locked position of the tensioner, the fourth pivot axis is on a second side of the plane containing the second and third pivot axes, and the second support is prevented from pivoting substantially relative to the first support about the first pivot axis for preventing the collapsible frame to move from the extended configuration to the collapsed configuration. The tension adjuster is operable to adjust a distance between the second and third pivot axes in the locked position of the tensioner.

In some embodiments, one of the first and second arms defines a slot, the corresponding one of the second and third pivot axes of the one of the first and second arms being movable along the slot.

In some embodiments, the one of the first and second arms defining the slot is the second arm.

In some embodiments, the tension adjuster includes a translating member connected to one of the first and second arms, the translating member abutting a pivot member defining the corresponding one of the second and third pivot axes of the one of the first and second arms, and wherein translation of the translating member moves the pivot member relative to the one of the first and second arms to which the translating member is connected.

In some embodiments, the translating member has a threaded surface engaging a corresponding threaded surface of the one of the first and second arms.

In some embodiments, the translating member is a bolt.

In some embodiments, the tensioner further includes a lock selectively locking the tensioner in the locked position.

In some embodiments, the lock includes a tab extending from one of the first and second arms, the tab selectively hooking onto an other one of the first and second arms to lock the tensioner in the locked position.

In some embodiments, one of the first and second arms has lateral members projecting downwardly, the lateral members preventing access to an other of the one of the first and second arms in the unlocked position.

In some embodiments, one of the first and second arms substantially covers an other one of the first and second arms.

In some embodiments, in the locked position, the second arm extends between the second and third pivot axes and the first arm extends between the third and fourth pivot axes.

In some embodiments, in the collapsed configuration of the collapsible frame, the second arm is substantially parallel to a portion of at least one of the first and second supports.

In some embodiments, in the collapsed configuration of the collapsible frame, the first arm is received in the second arm.

In some embodiments, in the collapsed configuration of the collapsible frame, the second, third and fourth pivot axes are between the first and second supports.

In some embodiments, the unlocked position is a first unlocked position, and the unlocked position has a second unlocked position. In the extended configuration of the collapsible frame and in the locked position of the tensioner, the fourth pivot axis is between the second and third pivot axes. In the extended configuration of the collapsible frame and in the first unlocked position of the tensioner, the fourth pivot axis is between the second and third pivot axes. In the collapsed configuration of the collapsible frame and in the second unlocked position of the tensioner, the second pivot axis is between the third and fourth pivot axes and the fourth pivot axis is on the second side of the plane containing the second and third pivot axes.

According to another aspect of the present technology, there is provided a watercraft having a hull, a deck disposed on the hull, and a bimini according to at least one of the above aspects or according to at least one of the above aspects and one or more of the above embodiments.

In some embodiments, the first support is pivotally connected relative to the deck about a fifth pivot axis.

In some embodiments, the first support is pivotally connected to a side structure of the watercraft about the fifth pivot axis, and in the collapsed configuration of the collapsible frame, the bimini selectively pivots with respect to the side structure between a generally upright position to a stowed position.

In some embodiments, the watercraft further includes at least one stabilizer bar connected between the first support and the side structure in the extended configuration of the collapsible frame.

In some embodiments, in the collapsed configuration of the collapsible frame, the bimini selectively pivots with respect to the deck between a generally upright position to a stowed position.

For purposes of the present application, terms related to spatial orientation when referring to a watercraft and components in relation to the watercraft, such as "vertical", "horizontal", "forwardly", "rearwardly", "left", "right", "above" and "below", are as they would be understood by a driver of the watercraft sitting thereon in an upright driving position, with the watercraft being at rest and level.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects, and advantages of embodiments of the present technology will become apparent from the following description, the accompanying drawings, and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
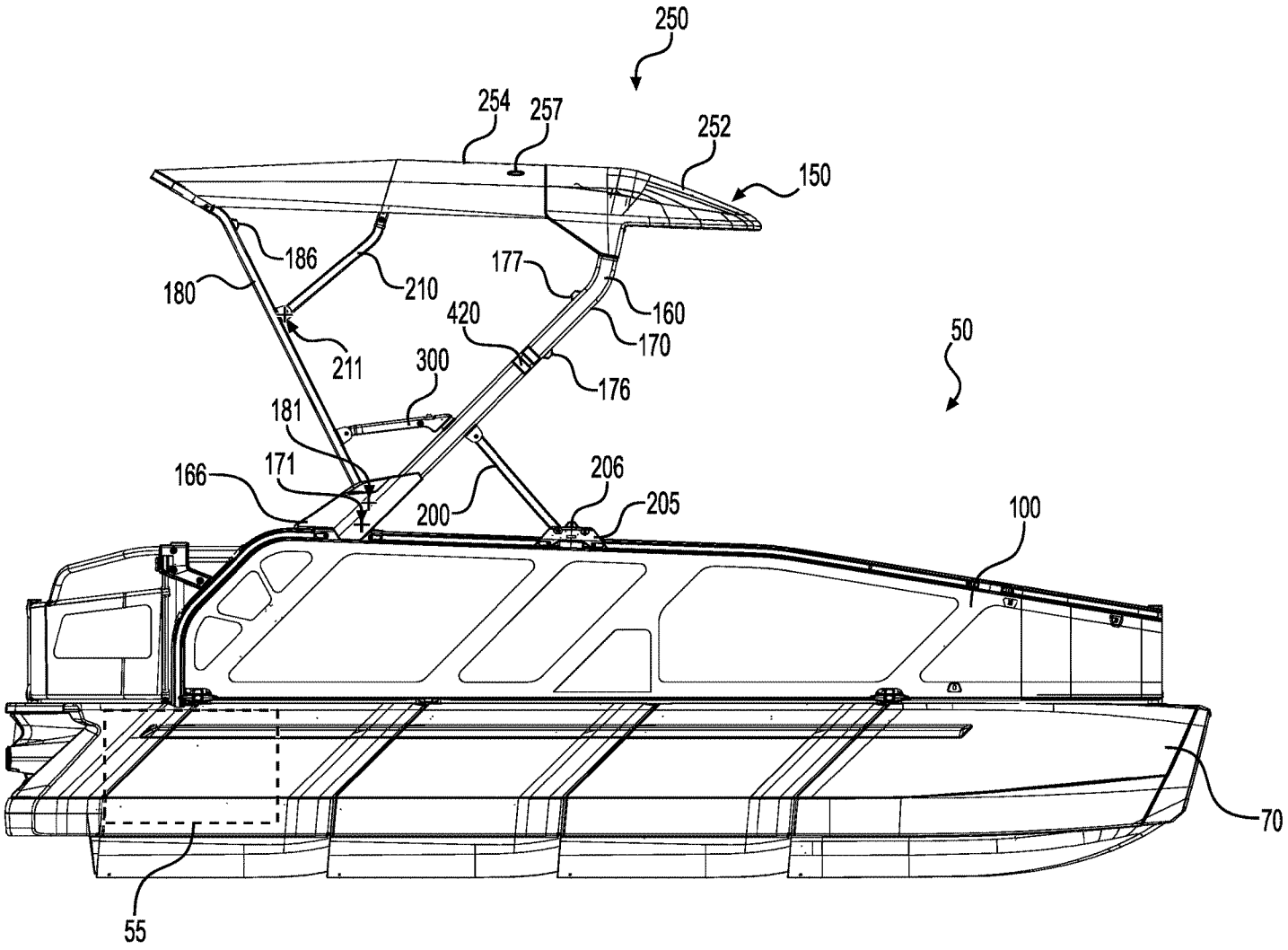
FIG. 1 is a right side elevation view of a boat with a bimini, the bimini having a collapsible frame connected to a barrier structure of the boat, a top and tensioners, where the collapsible frame is in an extended configuration and the tensioners are in a locked position.

A watercraft 50 with a bimini 150 having left and right tensioners 300 in accordance to an embodiment of the present technology is shown in FIGS. 1 to 4. The following description relates to one example of a watercraft 50, notably a pontoon boat 50. Those of ordinary skill in the art will recognize that there are other known types of watercraft incorporating different designs and that the present technology would encompass these other watercraft.

The boat 50 has a deck 60 and a hull 70. The deck 60 is disposed on the hull 70. and is supported thereby. The deck 60 has an upper surface 64 for supporting occupants, as well as accessories and accommodations of the boat 50 (e.g., seating, command console, etc.). It is contemplated that the deck 60 could include multiple levels and/or seating or other accessories integrated therein.

The boat 50 is propelled by a jet propulsion system (not shown) powered by a motor (not shown). The jet propulsion system has a steering nozzle (not shown) used for steering the boat 50. A steering device, such as a handlebar or a steering wheel (not shown), is operatively connected to the steering nozzle. A throttle lever (not shown) is operatively connected to the motor for controlling operation of the motor. The steering device and the throttle lever are located on a command console (not shown) provided on the deck 60. It is contemplated that other propulsion systems, such as a stern drive, marine outboard engine or marine inboard engine, may be used to propel the boat 50. It is also contemplated that that the steering nozzle could be replaced by an outdrive or one or more rudders.

A powerpack 55 (schematically illustrated in FIGS. 1 to 3) of the boat 50, including the jet propulsion system and the motor, is enclosed in part by the hull 70.

Figure 4:
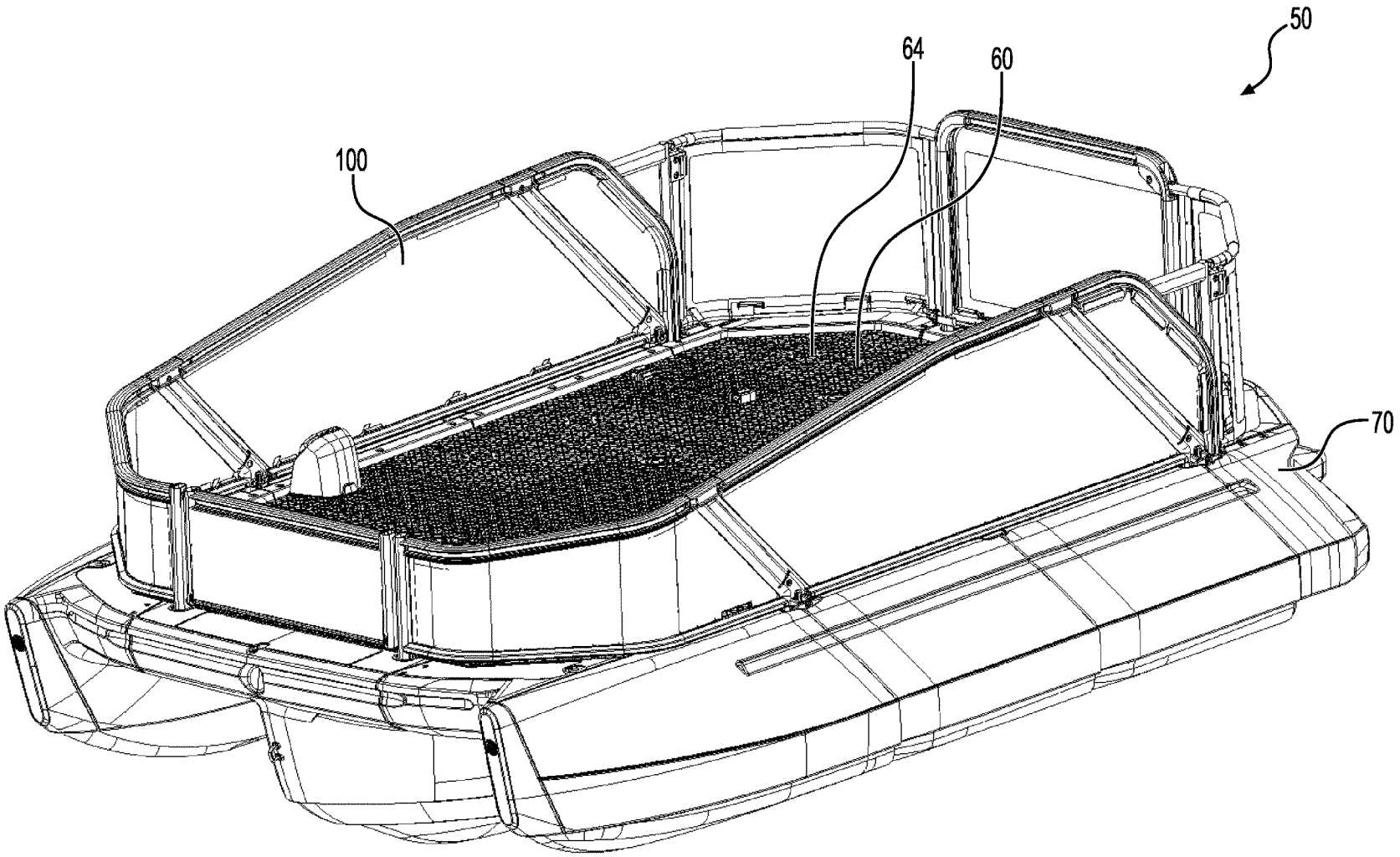
FIG. 4 is a perspective view taken from a top, front, left side of the boat of FIG. 1, with the bimini being omitted.
Figure 5:
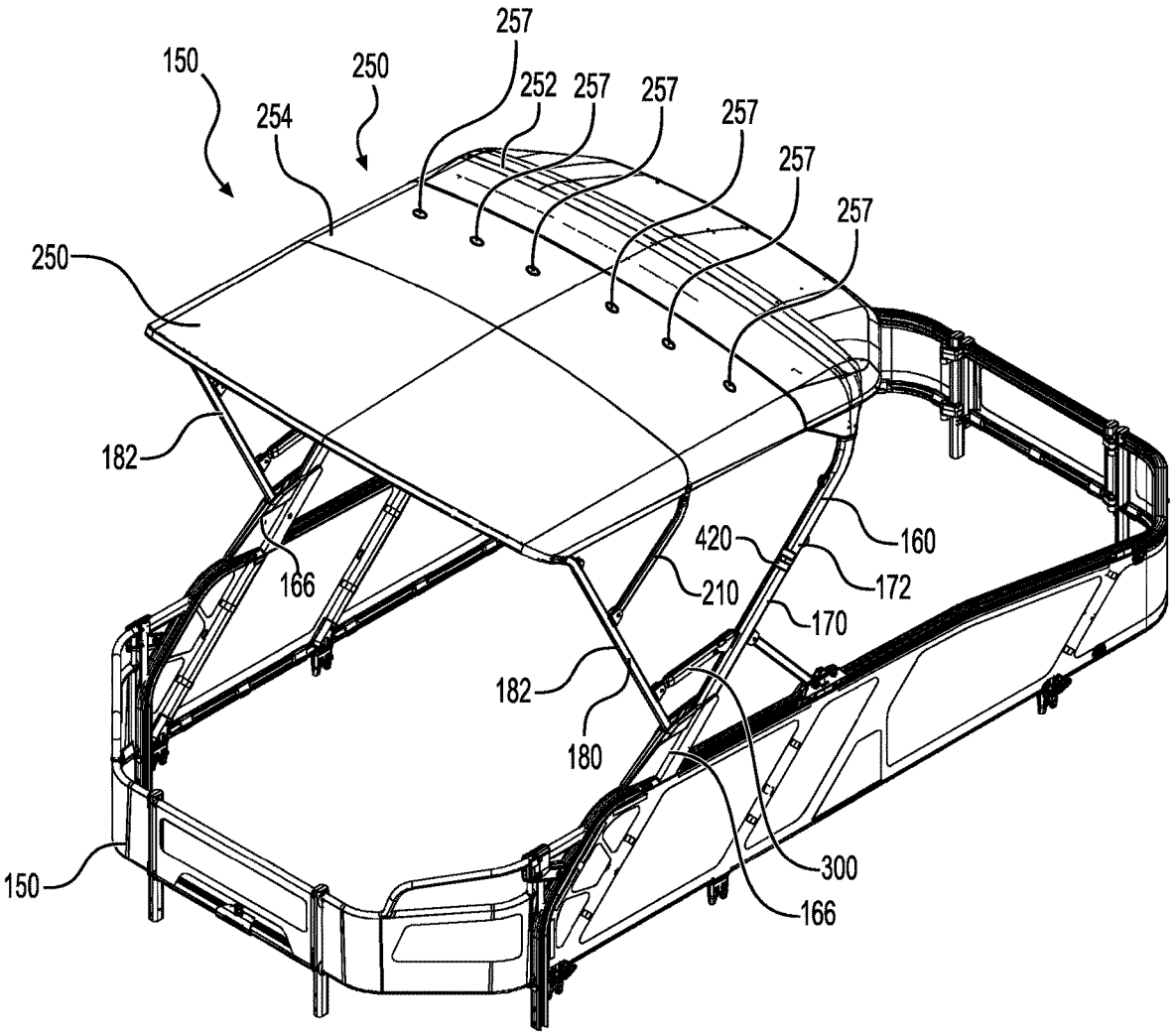
FIG. 5 is a perspective view taken from a top, rear, right side of the bimini of FIG. 1 connected to the barrier structure.
Figure 6:
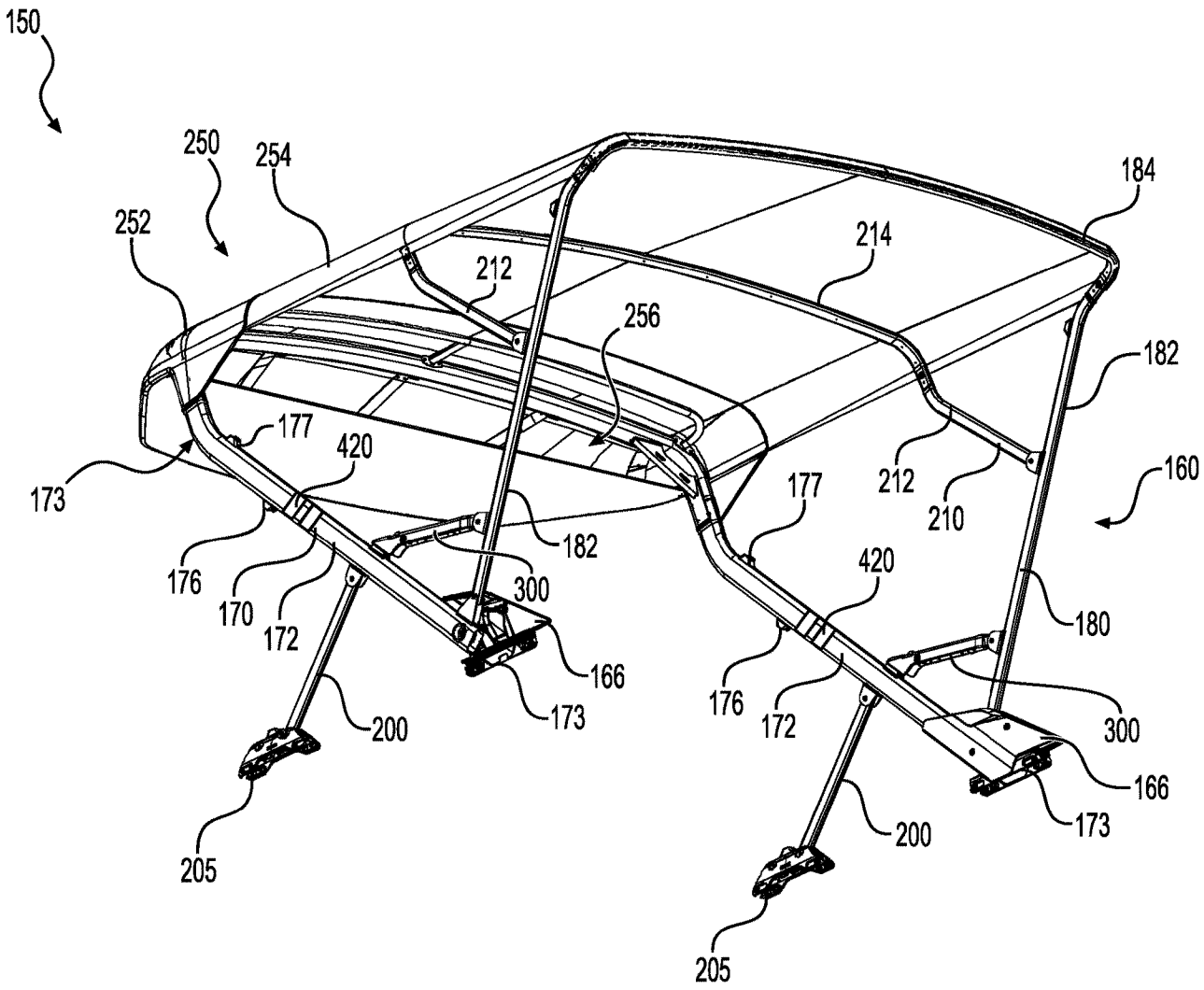
FIG. 6 is a perspective view taken from a bottom, rear, left side of the bimini of FIG. 5, with the barrier structure being omitted.
Figure 7:
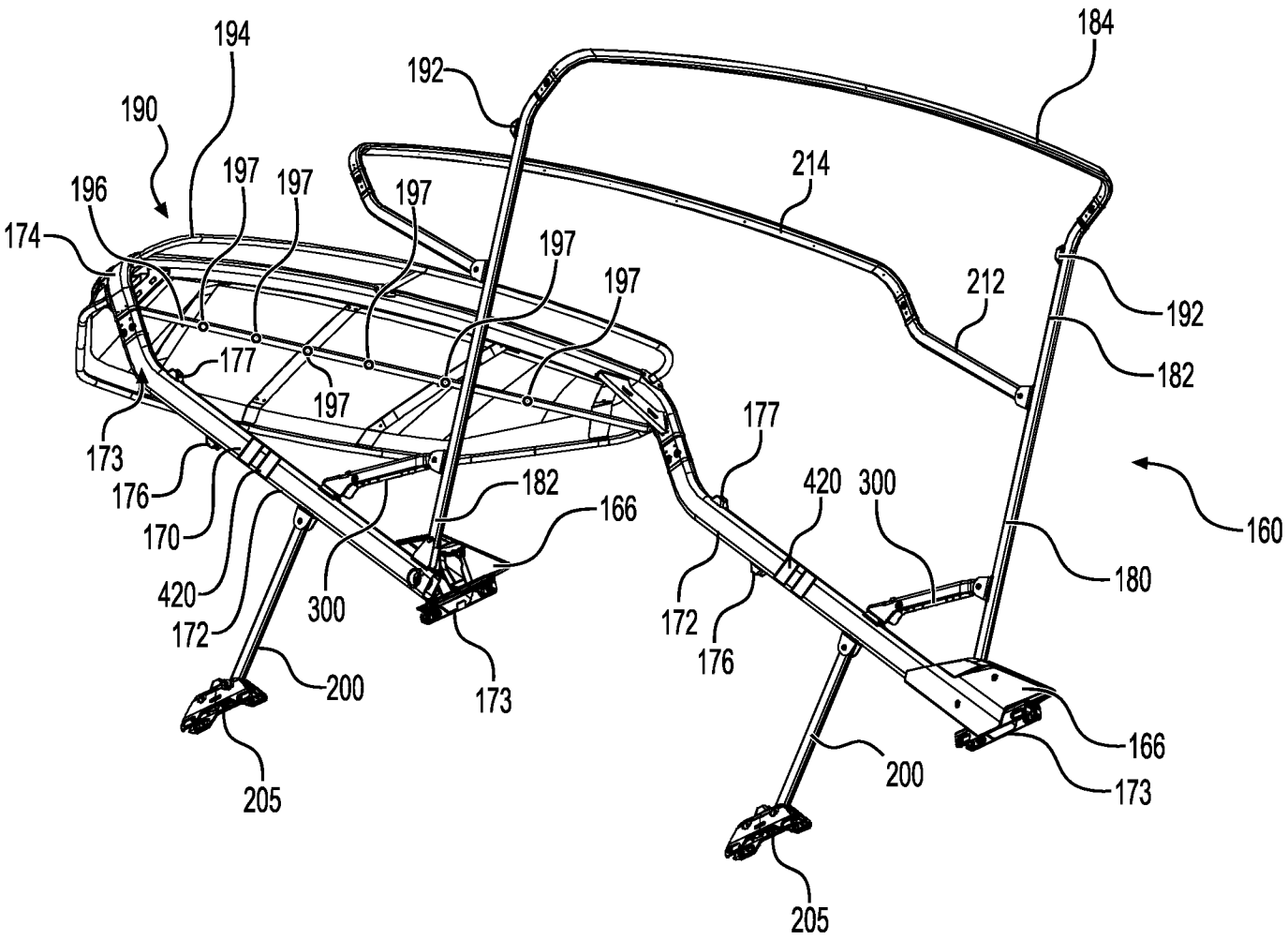
FIG. 7 is a perspective view taken from a bottom, rear, left side of the bimini of FIG. 6, with the top being omitted.
Figure 8:
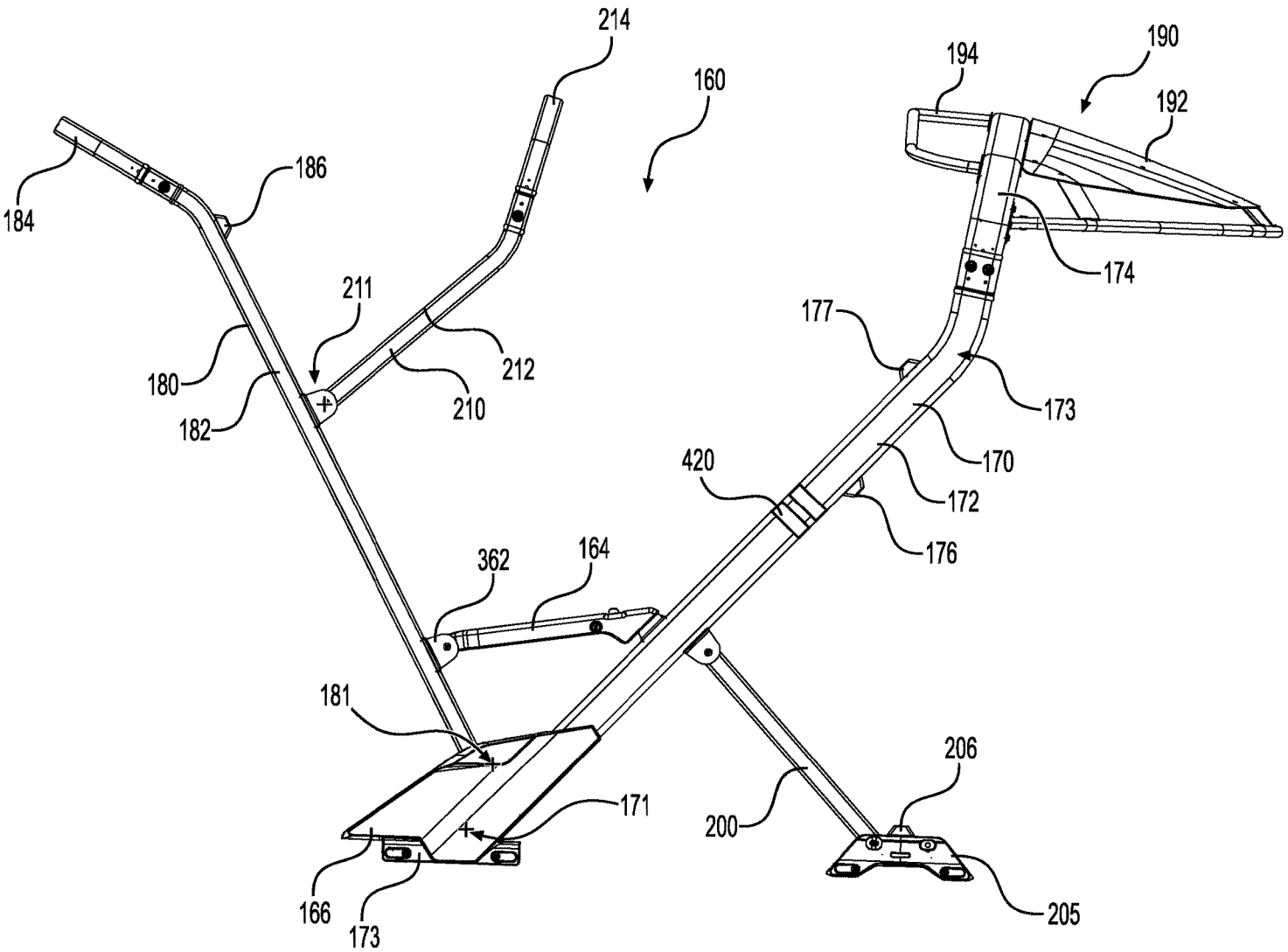
FIG. 8 is a right side elevation view of the bimini of FIG. 7, with the top being omitted.
Figure 9:
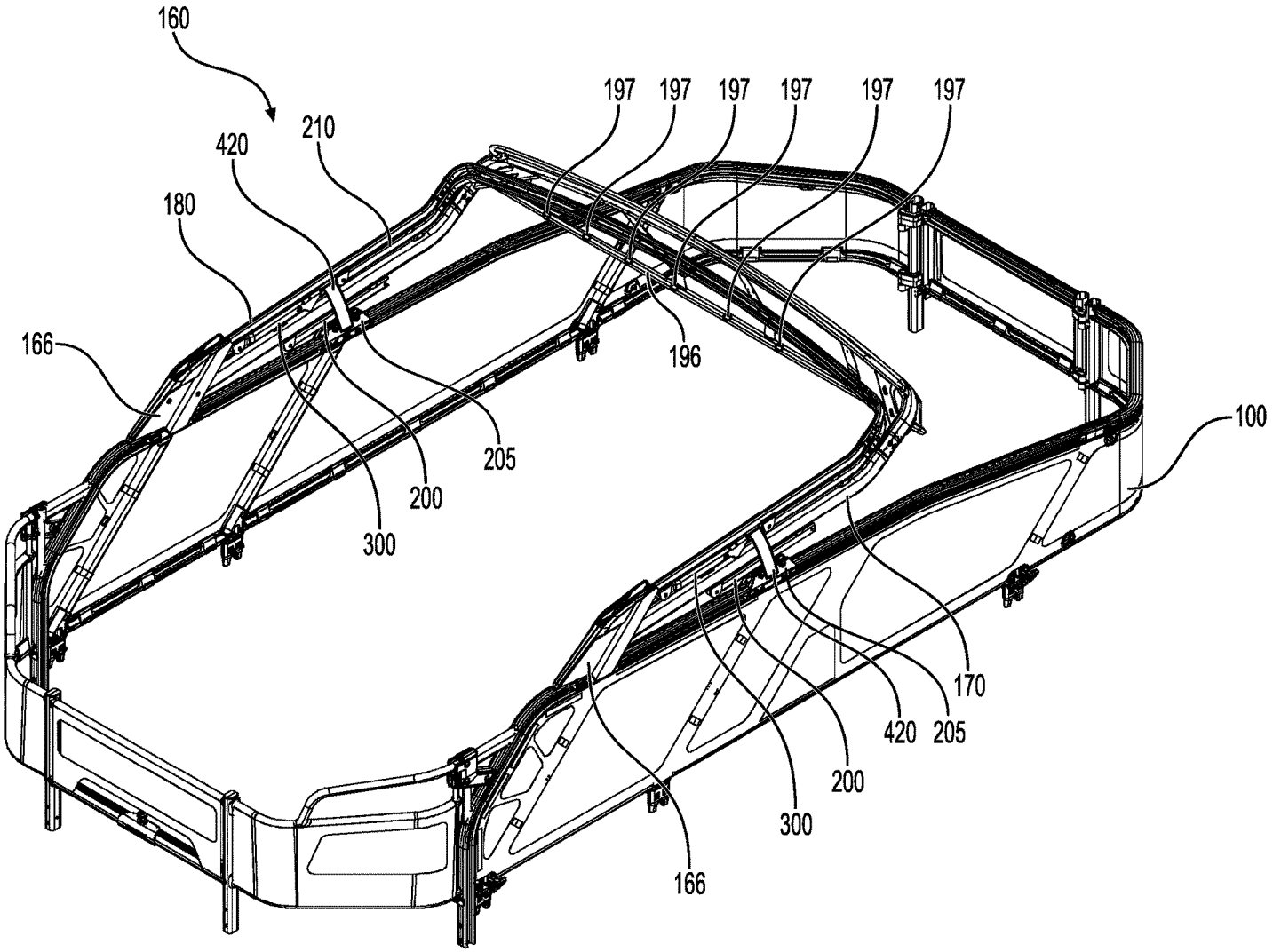
FIG. 9 is a perspective view taken from a top, rear, right side of the bimini of FIG. 3, the bimini being in the stowed position with the top being omitted, connected to the barrier structure.

The boat 50 has a side structure 100 surrounding at least part of the deck 60 and extending upwardly therefrom. In the present embodiment, the side structure 100 is a barrier structure 100. It is contemplated that that in some embodiments, the side structure 100 could be gunnels of the boat 50 or another structure extending vertically from the surface 64. The barrier structure 100 is located along a periphery of the boat 50 (as defined by the deck 60) to prevent occupants or objects on the deck 60 from accidentally falling off the boat 50. As best seen in FIG. 4, the barrier structure 100 generally surrounds the entirety of the deck 60. It is contemplated that, in other embodiments, the barrier structure 100 could only partially surround the deck 60.

The bimini 150 is connected to the deck 60 via the barrier structure 100. It is contemplated that the bimini 150 could be connected to the deck 60 differently. For instance, in the embodiments where the boat 50 does not have a barrier structure, the bimini 150 could be connected to gunnels of the boat 50. It is also contemplated that in some embodiments, the bimini 150 could be connected directly to the deck 60.

The bimini 150 will now be described in more detail with respect to FIGS. 5 to 10. The bimini 150 has a collapsible frame 160 and a top 250 connected thereto. The collapsible frame 160 is movable between an extended configuration (shown in FIG. 1) and a collapsed configuration (shown in FIG. 2). Furthermore, when the collapsible frame 160 is in the collapsed configuration, the bimini 150 itself is pivotable between an upright position (shown in FIGS. 1 and 2) and a stowed position (shown in FIG. 3). In the extended configuration, the top 250 is taut, in part due to the tensioners 300 as will be described in greater detail below, and the bimini 150 can thereby provide some shelter from the elements to riders of the boat 50. In the collapsed configuration, the top 250 is partially folded and stored in the structure of the bimini 150 as will be described below. In the collapsed configuration of the collapsible frame 160 with the bimini 150 in the upright position, the bimini 150 still offers some protection from the elements, although less than in the extended configuration. In the stowed position, the bimini 150 is positioned to facilitate putting the boat 50 in storage or placing the boat 50 on a trailer. The stowed position is also used when the boat 50 is to be docked for prolonged periods.

Referring to FIGS. 5 to 8, the collapsible frame 160 will now be described in greater detail. The collapsible frame 160 includes a front support 170 and a rear support 180. The collapsible frame 160 is made from aluminum or stainless steel, but other materials are contemplated.

The front support 170 is pivotally connected to the barrier structure 100 about a pivot axis 171. The front support 170 has two lateral members 172 and a top member 174 that is connected to the two lateral members 172. It is contemplated that in some embodiments, the front support 170 could be one integral member or that it could be composed of more members. The two lateral members 172 are pivotally connected to brackets 173 that are connected to the top of the barrier structure 100. The two lateral members 172 have upper ends that are angled relative to the rest of the lateral members 172. Each of the two lateral members 172 are provided with a bumper 176 connected to and projecting from a front side thereof, and a bumper 177 connected to and projecting from a rear side thereof. The top member 174 has curved ends such that the top member 174 forms an inverted U-shape to connect to the lateral members 172. The front support 170 is configured so that in the extended configuration of the collapsible frame 160 and the upright position of the bimini 150, the lateral members 172 extend upward and forward from the pivot axis 171 and the ends of the top member 174 also extend forward and upward, but are more vertically oriented than the lateral members 172.

The collapsible frame 160 also includes a cavity frame 190 that is attached to the front support 170. More precisely, the cavity frame 190 is attached to the top member 174 of the front support 170. The cavity frame 190 has a front cavity frame portion 192 and a rear cavity frame portion 194.

The front cavity frame portion 192 extends from the front support 170 away from the rear support 180. The front cavity frame portion 192 includes a frame member 196 that extends transversally. The rear cavity frame portion 194 extends from the front support 170 away from the cavity frame portion 192 toward the rear support 180.

The frame member 196 is vertically lower than the rear cavity frame portion 194. The frame member 196 has six inner clips 197 connected thereto by straps (not shown). The six inner clips 197 are male clips 197. It is contemplated that in some embodiments, the inner clips 197 could be other connectors such as female clips, hooks or studs for example. It is also contemplated that the inner clips 197 could be connected elsewhere on the bimini 150 such as on the top 250 for instance.

Left and right stabilizers 200 each have an upper end that is pivotally connected to a corresponding one of the front supports 170. Left and right brackets 205 are connected to the top of the barrier structure 100. Each of the left and right stabilizers 200 also has a lower end that is selectively connected to the left and right brackets 205 to support the front support 170 in the position shown in FIG. 8. The left and right brackets 205 have bumpers 206 projecting therefrom. The left and right brackets 205 each also define an aperture 207 which, as will be described below, is configured to receive a portion of a holding strap 420 therein. As will be described in greater detail below, the stabilizers 200 are disconnected from the brackets 205 when the bimini 150 is pivoted from the upright position to the stowed position. It is contemplated that the stabilizers could be pivotally connected to the barrier structure 100 and that the brackets 205 could be selectively connected to the front of the front support 170.

The rear support 180 is pivotally connected to the front support 170 about a pivot axis 181. The rear support 180 has two lateral members 182 and a top member 184 that is connected to the two lateral members 182. It is contemplated that in some embodiments, the rear support 180 could be one integral member or that it could be composed of more members. The two lateral members 182 have upper ends that are angled relative to the rest of the lateral members 182. Each of the two lateral members 182 are provided with a bumper 186 projecting from a front side thereof. The top member 184 has curved ends such that the top member 184 forms an inverted U-shape that connects to the lateral members 182. The rear support 180 is configured so that in the extended configuration of the collapsible frame 160, the lateral members 172 extend upward and rearward from the pivot axis 181 and the ends of the top member 184 also extend upward and rearward, but are less vertically oriented than the lateral members 172.

The collapsible frame 160 also includes an intermediate support 210 that is pivotally connected to the rear support 180. The intermediate support 210 is pivotable about a pivot axis 211. The intermediate support 210 is connected to the front of the lateral members 182 of the rear support 180 such that the intermediate support 210 is located between the front support 170 and the rear support 180. The intermediate support 210 also has two lateral members 212 and a top member 214 that is connected to the two lateral members 212. It is contemplated that in some embodiments, the intermediate support 210 could be one integral member or that it could be composed of more members. The two lateral members 212 have upper ends that are angled relative to the rest of the lateral members 212. The top member 214 has curved ends such that the top member 214 forms an inverted U-shape that connects to the lateral members 212. The intermediate support 210 is configured so that in the extended configuration of the collapsible frame 160, the lateral members 212 extend upward and forward from the pivot axis 211 and the ends of the top member 214 also extend forward and upward, but are more vertically oriented than the lateral members 212.

The bimini 150 includes the left and right tensioners 300 that are connected between the front support 170 and the rear support 180. More precisely, the tensioners 300 are connected to the lateral members 172 of the front support 170 and to the lateral members 182 of the rear support 180. The tensioners 300 each have locked and unlocked positions. When the collapsible frame 160 is in the extended configuration and the tensioners 300 are in the locked position, the collapsible frame 160 is locked in the extended configuration. When the collapsible frame 160 is in the extended configuration and the tensioners 300 are in the unlocked position, the collapsible frame 160 can be moved from the extended configuration to the collapsed configuration.

The bimini 150 also has left and right tension adjusters 400 (shown in FIGS. 13 and 17) that are respectively connected to the left and right tensioners 300. Generally, the tension adjusters 400 are operable to adjust the distance between the front and rear supports 170, 180, which helps to ensure that the top 250 remains taut. The tension adjusters 400 will also be described in greater detail below.

The left and right covers 166 are connected to the brackets 173, and are also connected to the barrier structure 100. The covers 166 cover where the bottom portions of the front support 170 pivotally connect to the brackets 173 about the pivot axis 171. The covers 166 also cover where the bottom portions of the rear support 180 pivotally connect to the front support 170 about the pivot axis 181.

The bimini 150 also has the holding straps 420, which are connected to the front support 170. More precisely, one of the holding straps 420 is connected to one of the lateral members 172 and another one of the holding straps 420 is connected to the other one of the lateral members 172. It is contemplated that in some embodiments, the holding straps 420 could be connected to the rear support 180. As the two holding straps 420 are similar, only one will be described. The holding strap 420, which is riveted to the lateral member 172, has hook and loop fasteners provided at one end, and a buckle 422 (shown in FIGS. 10 and 18) provided at the other end. The buckle 422 is configured to receive the end having the hook and loop fasteners therethrough. It is contemplated that the holding strap 420 could be connected to the lateral member 172 differently, for instance by another fastener or by being received in an aperture defined in the lateral member 172. The holding strap 420 is configured so that when the bimini 150 is in the stowed position and the collapsible frame 160 is in the collapsed configuration, the end having the hook and loop fasteners can first be received through the aperture 207 of the corresponding bracket 205, can then be received through the corresponding buckle 422, and can then connect to itself thanks to the hook and loops fasteners, thereby holding the bimini 150 in its position. When the bimini 150 is not in the stowed position, the holding strap 420 can be wrapped around the lateral member 172, then the end having the hook and loops fasteners can be received through the buckle 422 before connecting to itself thanks to the hook and loop fasteners. It is contemplated that in some embodiments, the holding straps 420 and the buckle 422 could be a belt having a belt buckle at one end and a row of apertures defined in the opposite end portion. In yet other embodiments, the holding straps 420 and the buckle could be a holding strap and a carabiner.

The top 250 will now be described in greater detail. The top 250, which consists of one integral flexible piece, has a front top portion 252 and a rear top portion 254. It is contemplated that in some embodiments, the top portions 252, 254 could be two distinct pieces that are sewn or otherwise connected together. It is further contemplated that the top portions 252, 254 could be two distinct pieces that are selectively connected such that, for example, the front top portion 252 could be removed from the bimini 150 and replaced. In the present embodiment, the top is made of waterproof canvas, but other materials are contemplated.

The top 250 is connected to the collapsible frame 160 such that the top 250 extends between the front support 170 and the rear support 180. The front top portion 252 surrounds the cavity frame 190. More precisely, the front top portion 252 extends above and below the cavity frame portion 192 and above the cavity frame portion 194. The front top portion 252 thus defines a cavity 256 (best seen in FIG. 6). A portion of the cavity 256 is formed within the front cavity frame 192 and another portion of the cavity 256 is formed beneath the rear cavity frame portion 194. It is contemplated that in some embodiments, the front top portion 252 could only partially surround the cavity frame 190. It is also contemplated that in some embodiments where the top 250 is made of two distinct pieces, the front top portion 252 could be a rigid top portion 252 that defines the cavity 256, and could thereby replace the cavity frame 190.

The flexibility of the rear top portion 254 permits the rear top portion 254 to be folded when the collapsible frame 160 moves from the extended configuration to the collapsed configurations. As will be described in greater detail below, the rear top portion 254 can be at least partially stored in the cavity 256 when folded. The top portion 254 has six outer clips 257 connected at a top thereof near the cavity frame 190. The six outer clips 257 are female outer clips 257. It is contemplated that in some embodiments, the outer clips 257 could be other connectors complementary to the inner clips 197, such as hooks or studs for example. It is also contemplated that the outer clips 257 could be connected elsewhere on the bimini 150, such as for instance proximate the top member 184 of the rear support 180 or on the cavity frame 190.

Referring to FIGS. 11 to 19, the left and right tensioners 300 will now be described in greater detail. As the left and right tensioners 300 are similar, only one will be described in detail herein. The tensioner 300 has a front arm 320 (see FIG. 13) that is pivotally connected to the front support 170 as well as a rear arm 360 that is pivotally connected to the rear support 180, and that is also pivotally connected to the front arm 320.

Figure 13:
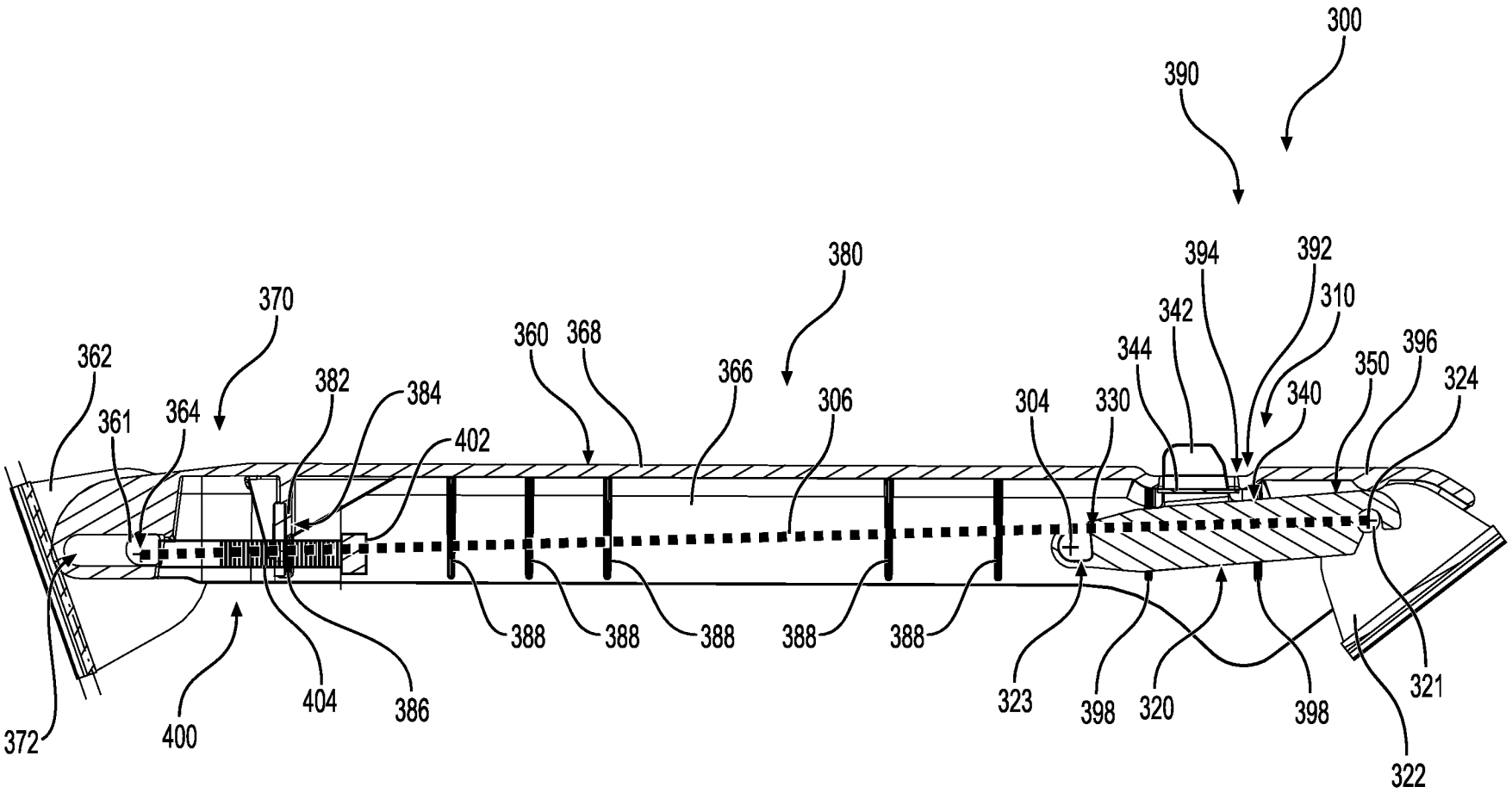
FIG. 13 is a cross-sectional view of the tensioner of FIG. 11 taken along the lines 13-13 of FIG. 12, with a tension adjuster being schematically shown.
Figure 14:
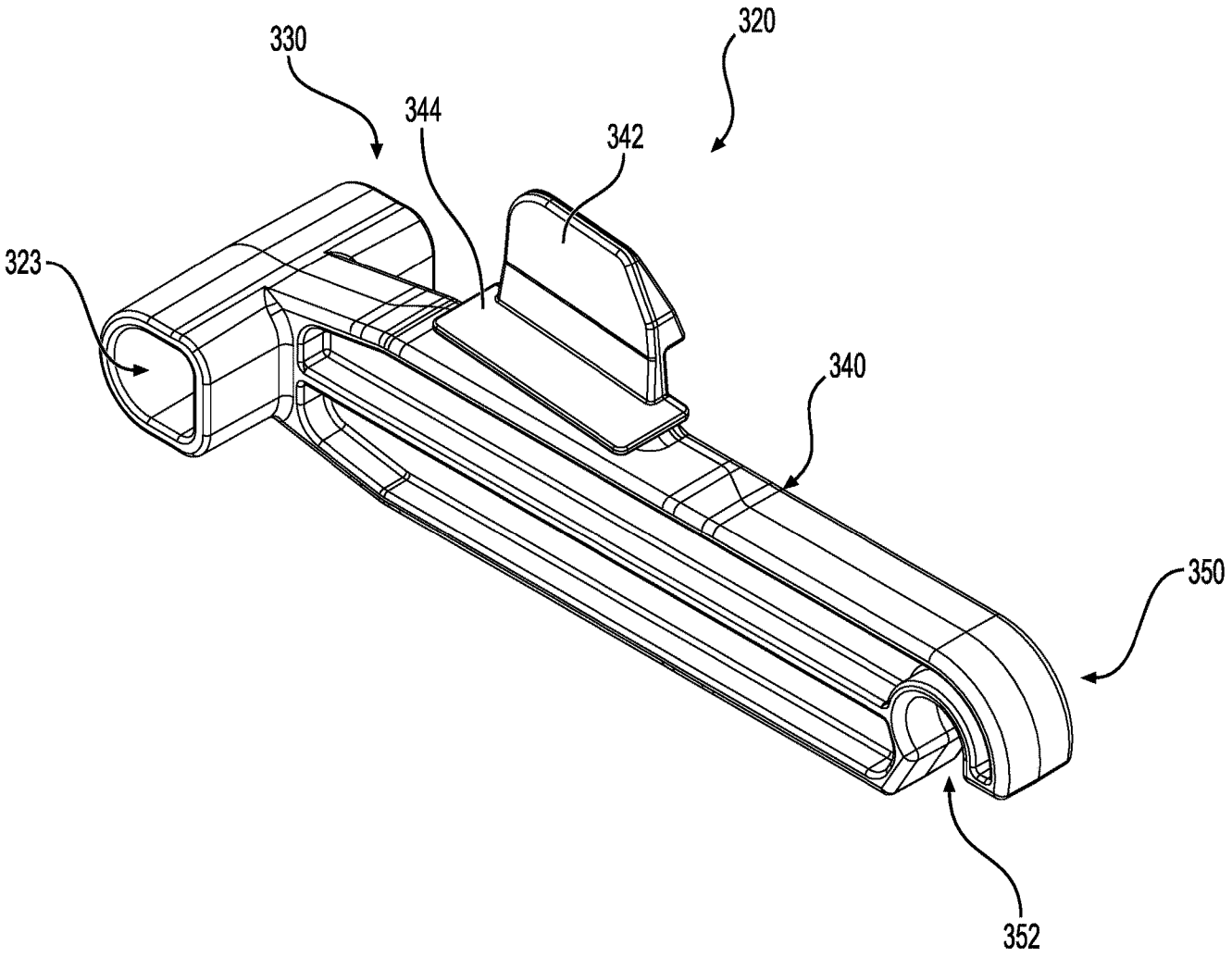
FIG. 14 is a perspective view taken from a top, front, right side of a front arm of the tensioner of FIG. 11.

Referring to FIGS. 13 and 14, the front arm 320 is pivotally connected to the front support 170 about a front pivot axis 324 by a front bracket 322. The front arm 320 has a rear portion 330, an intermediate portion 340 and a front portion 350. The rear portion 330 is wider than the intermediate and front portions 340, 350, and defines an aperture 323 that extends therethrough. The intermediate portion 340 connects the rear portion 330 to the front portion 350. The intermediate portion 340 also has a tab 342 that extends upwardly therefrom, which as will be described in greater detail below, is part of a lock 310. The tab 342 has a flat member 344 that projects in the lateral direction. The tab 342 is resiliently deformable and is biased to return toward an initial position when deformed. The front portion 350 defines a recess 352, such that the front portion 350 generally forms hook shape that is adapted to be pivotally connected to a pivot member 321 of the front bracket 322. The pivot member 321 defines the front pivot axis 324. It is contemplated that in some embodiments, the front portion 350 could have another shape. The front arm 320 is one integral component, though it is contemplated that in some embodiments, it could be two or more components connected together.

Figure 15:
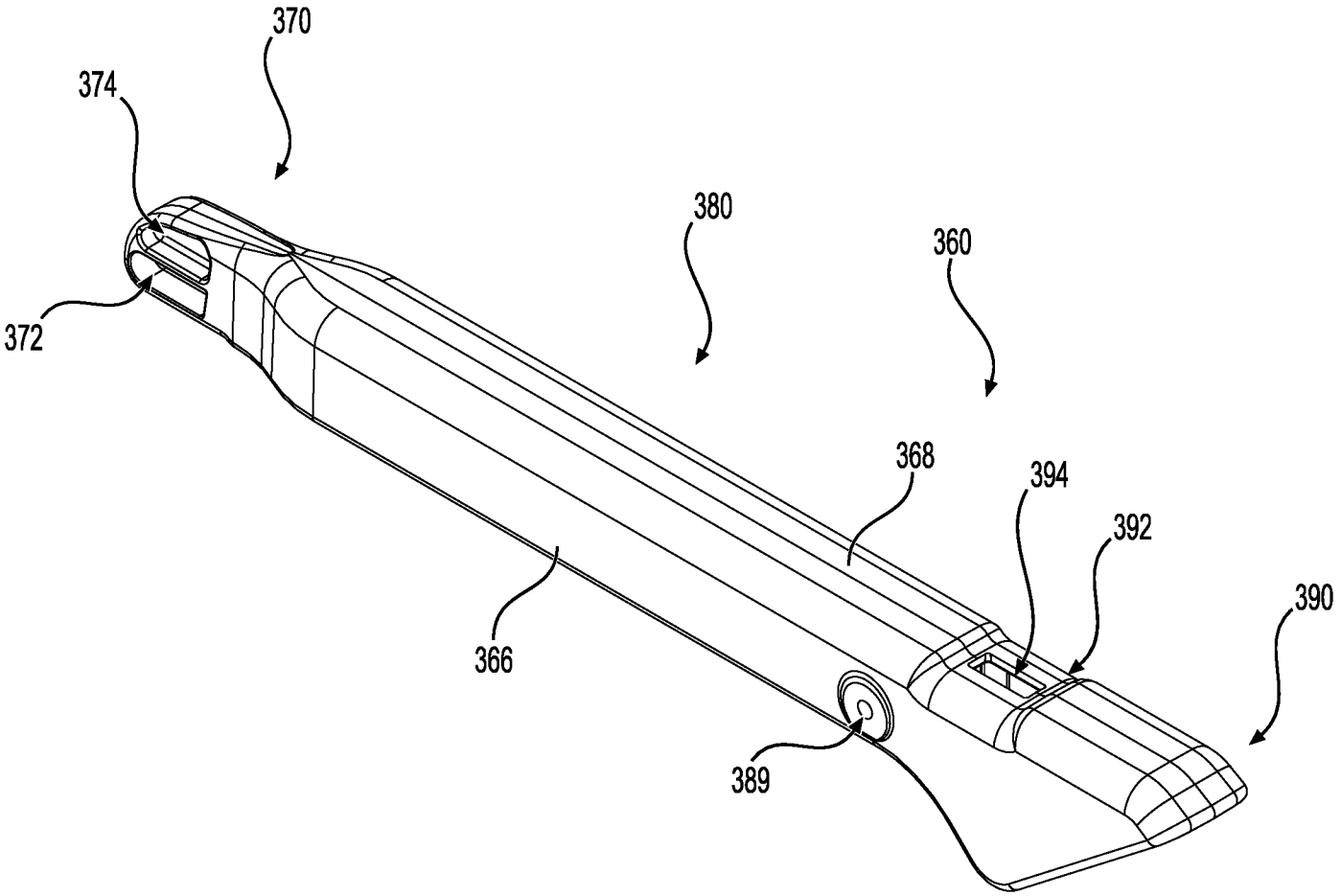
FIG. 15 is a perspective view taken from a top, front, right side of a rear arm of the tensioner of FIG. 11.

Referring to FIGS. 13 and 15, the rear arm 360 is pivotally connected to the rear support 180 about a rear pivot axis 364 by a rear bracket 362. The rear arm 360 has a rear portion 370, an intermediate portion 380 and a front portion 390. The rear arm 360 has lateral members 366 projecting downwardly from an upper member 368. The lateral members 366 and the upper member 368 extend along the intermediate and front portions 380, 390 of the rear arm 360. The intermediate and front portions 380, 390 are wider than the rear portion 370, and are also hollow, which, as will be described in greater detail below, enable the rear arm 360 to receive the front arm 320 therein. The rear portion 370 defines a slot 372 therethrough. The slot 372 extends longitudinally along the rear portion 370, and is adapted to be pivotally connected to a pivot member 361 of the rear bracket 362. The pivot member 361 defines the rear pivot axis 364. The rear portion 370 also defines recesses 374 above the slot 372. The recesses 374 are defined on the left and right side of the rear portion 370. The intermediate portion 380 connects the rear portion 370 to the front portion 390. The intermediate portion 380 has a connecting member 382 (shown in FIGS. 13, 17 and 19) that defines an aperture 384 that receives a bolt 402 of the tension adjuster 400. The connecting member 382 has a threaded surface 386 that corresponds to a threaded surface 404 of the bolt 402. The intermediate portion 380 further has five reinforcing ribs 388 that provide structural support to the rear arm 360. The intermediate portion 380 also defines one aperture 389 on each of the lateral members 366. As will be described in greater detail below, the front and rear arms 320, 360 are pivotally connected to one another such that the aperture 323 is aligned with the apertures 389. The front portion 390 defines a recess 392 on the upper member 368. The front portion 390 further defines an aperture 394 in the recess 392, which as will be described in greater detail below, is part of the lock 310. The aperture 394 is adapted to receive the tab 342 therethrough. However, the aperture 394 is sized such that the flat member 344 of the tab 342 cannot pass through the aperture 394, thereby blocking any foreign objects from passing through the aperture 394. The lateral members 366, at the front portion 390, project further downwardly relative to the rest of the rear arm 360. The front portion 390 also has a semi-circular projection 396 that projects from an interior side of the upper member 368 as well as two reinforcing ribs 398 that provide structural support to the rear arm 360.

It is also contemplated that in other embodiments, features that are currently present on the front arm 320 could be interchanged with features that are present on the rear arm 360. For instance, in some embodiments, the tab 342 could be on the rear arm 360. In other embodiments, the slot 372 could be on the front arm 320.

Figure 11:
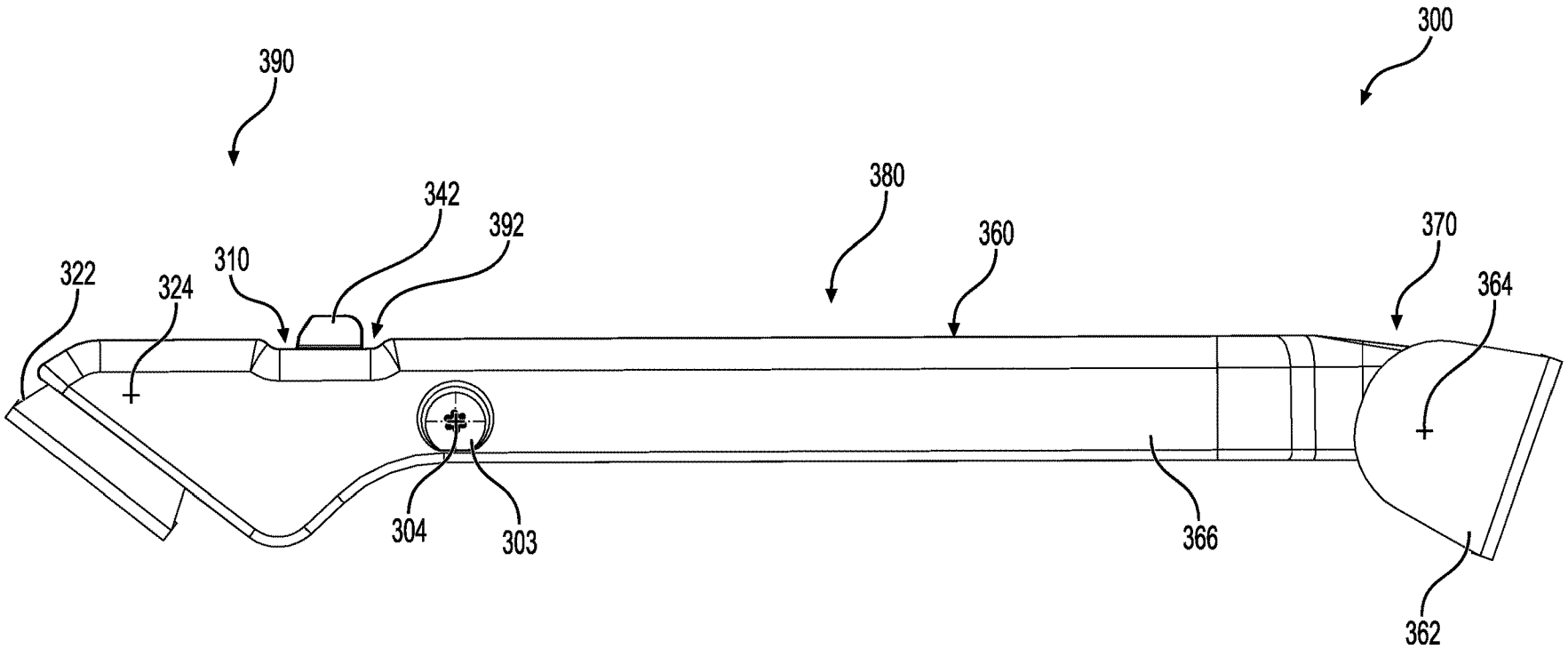
FIG. 11 is a left side elevation view of one of the tensioners of FIG. 1, the tensioner being in a locked position.
Figure 12:
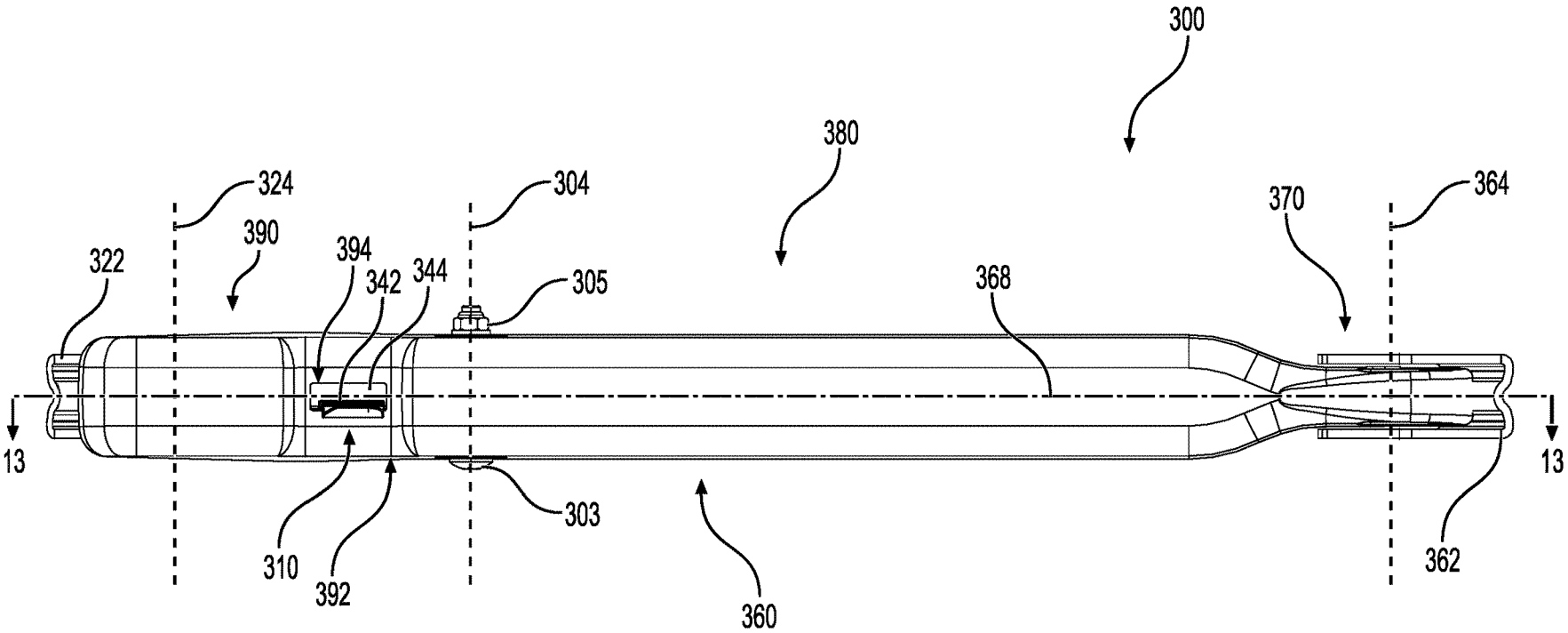
FIG. 12 is a top plan view of the tensioner of FIG. 11.

Referring to FIGS. 11 to 13, the connection between the front and rear arms 320, 360 will now be described in greater detail. The front arm 320 is received in the rear arm 360 such that the rear arm 360 substantially covers the front arm 320. The aperture 323 of the front arm 320 is aligned with the apertures 389 of the rear arm 360. A bolt 303, which defines an intermediate pivot axis 304, is inserted through the apertures 323, 389. A nut 305 secures the bolt 303 to the front and rear arms 320, 360. Thus, the front and rear arms 320, 360 are pivotally connected to one another about the intermediate pivot axis 304. The position of the intermediate pivot axis 304 relative to a plane 306 that contains the front and rear pivot axes 324, 364 changes whether the tensioner 300 is in the locked or the unlocked position as will be described further below.

As previously mentioned, the tensioner 300 has a locked position and unlocked positions. The tensioner 300 has an intermediate unlocked position shown in FIGS. 16 and 17, a collapsed unlocked position shown in FIGS. 18 and 19, as well as other unlocked positions between the locked position and the collapsed unlocked position (not shown).

Figure 16:
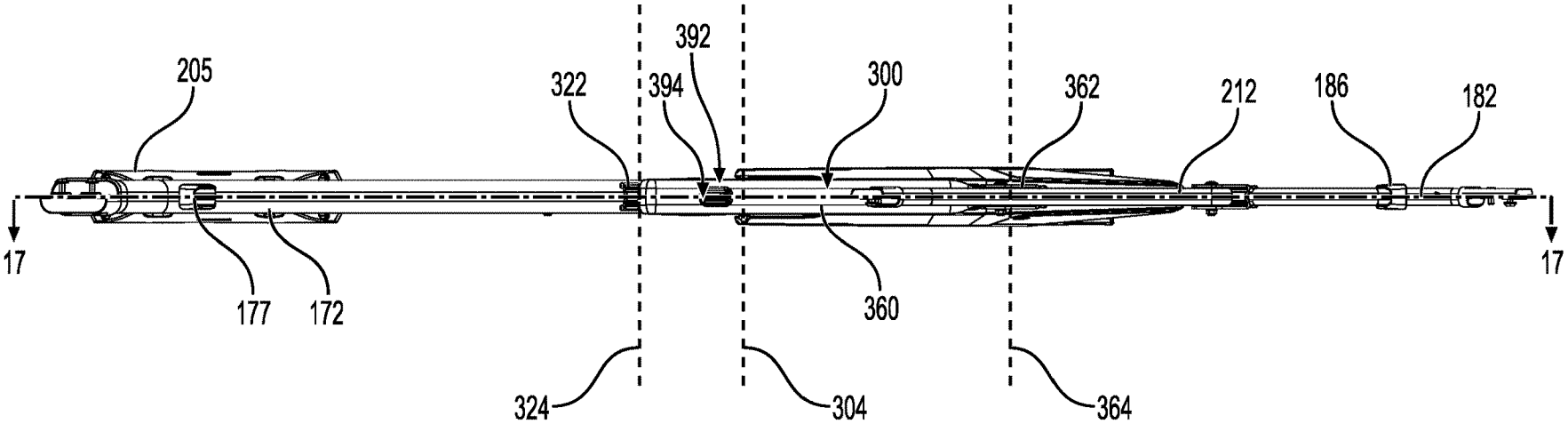
FIG. 16 is a top plan view of a portion of the bimini of FIG. 1 in an extended configuration, the top being omitted and the tensioner being in an intermediate unlocked position.
Figure 17:
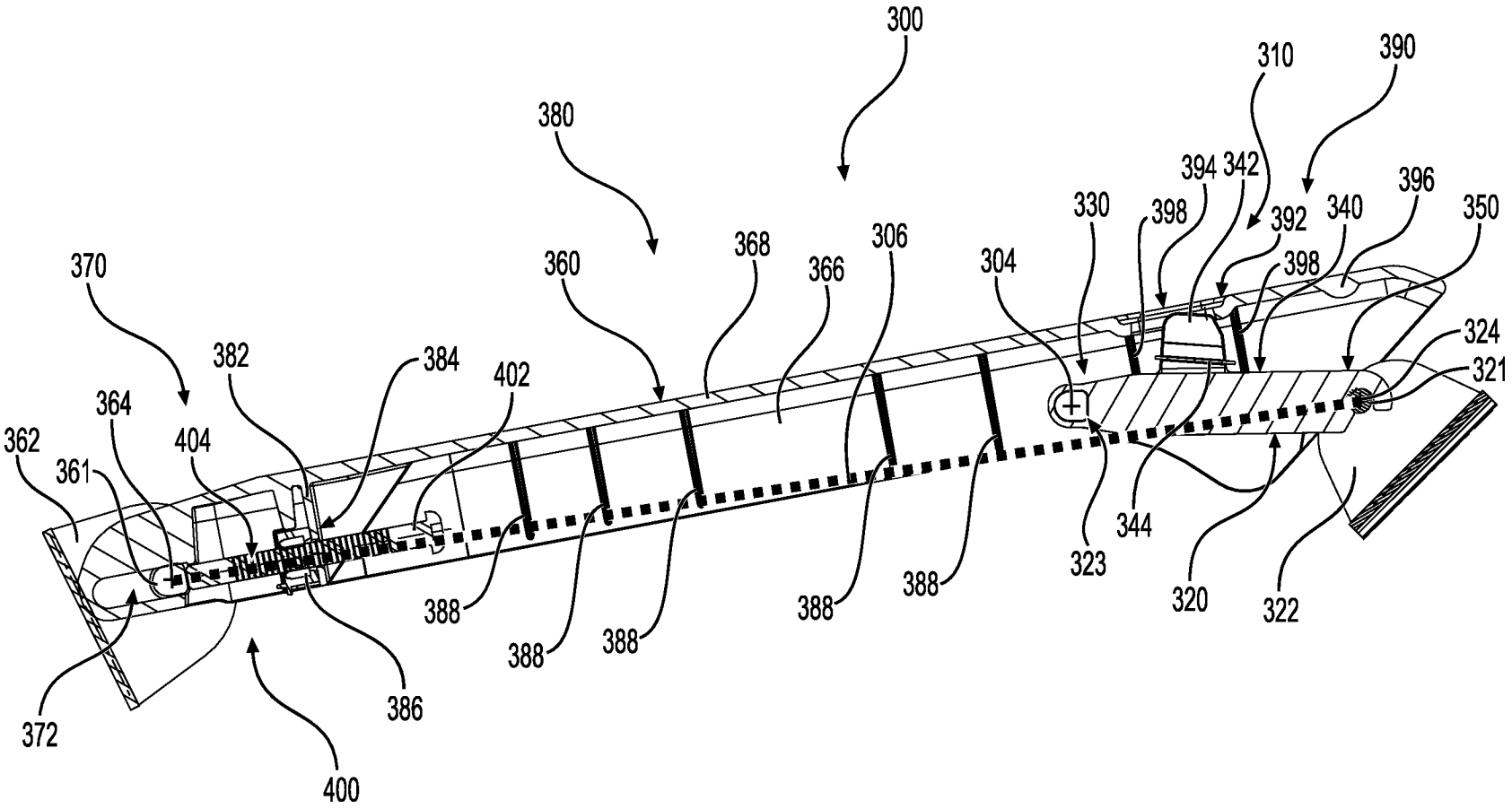
FIG. 17 is a cross-sectional view of the tensioner of FIG. 16 taken along the lines 17-17 of FIG. 16, with the tension adjuster being shown.

Referring to FIGS. 16 and 17, when the tensioner 300 is in the intermediate unlocked position, the collapsible frame 160 is in the extended configuration, and the intermediate pivot axis 304 is above the plane 306. The lateral members 366 of the rear arm 360 prevent, to some extent, access to the front arm 320 when the tensioner 300 is in the intermediate unlocked position.

To move the tensioner 300 from the intermediate unlocked position to the locked position, the rear arm 360 is pushed downwardly, such that the rear arm 360 pivots about the rear pivot axis 364 and the front arm 320 pivots about the front pivot axis 324, such that the front pivot axis 324 and the rear pivot axis 364 move away from one another, resulting in the intermediate pivot axis 304 moving downwardly. The intermediate pivot axis 304 moves from above the plane 306, reaches a position where the intermediate pivot axis 304 is contained in the plane 306, and, as the intermediate pivot axis 304 moves downwards from the plane 306 and the front and rear pivots axes 324, 364 begin to move toward each other, ultimately reaches a position below the plane 306 at which point the front portion 350 of the front arm 320 abuts the semi-circular projection 396, thereby preventing the intermediate pivot axis 304 from moving downwardly any further. When the intermediate pivot axis 304 is below the plane 306, the tensioner 300 is in the locked position and the rear support 180 is prevented from pivoting about the pivot axis 181. As the intermediate pivot axis 304 is moving downwardly, the lock 310 of the tensioner 300 is engaged. The tab 342 starts passing through the aperture 392, until the flat member 344 almost abuts an interior side of the upper member 368, which coincides with the front portion 350 of the front arm 320 abutting the semi-circular projection 396, thus the tensioner 300 reaching the locked position, and at which point the tab 342 is hooking onto the rear arm 360. The front and rear arms 320, 360 and the front, intermediate and rear axes 324, 304, 364 are configured to define an overcenter mechanism, which is stable in the locked position. However, when engaged, the lock 310, through the tab 342 and the flat member 344, further prevents the movement of the front and rear arms 320, 360 and thus ensures any substantial movement of the intermediate pivot axis 304, thereby preventing an upward force applied at the intermediate pivot axis from unlocking the tensioner 300. It is contemplated that other locks such as clips, latches and/or spring-loaded pins could be used to lock the tensioner 300 in the locked position. It is further contemplated that the lock 310 could be omitted.

When the tensioner 300 is in the locked position, the collapsible frame 160 is locked in the extended configuration.

To move the tensioner 300 from the locked to the intermediate unlocked position, the lock 310 is first disengaged by resiliently deforming the tab 342 such that the tab 342 no longer hooks to the rear arm 360. Then, while the tab 342 is still deformed, the rear arm 360 is pivoted about the rear pivot axis 364 while simultaneously removing the tab 342 from the aperture 394, which results in the intermediate pivot axis 304 moving in the upwards direction. When the intermediate pivot axis 304 is above the plane 306, the tensioner 300 is in the intermediate unlocked position.

Once the tensioner 300 is in the intermediate unlocked position, the collapsible frame 160 can be moved from the extended configuration to the collapsed configuration. As the collapsible frame 160 moves to the collapsed configuration, the tensioner 300 also moves from the intermediate unlocked position to the collapsed unlocked position.

Figure 18:
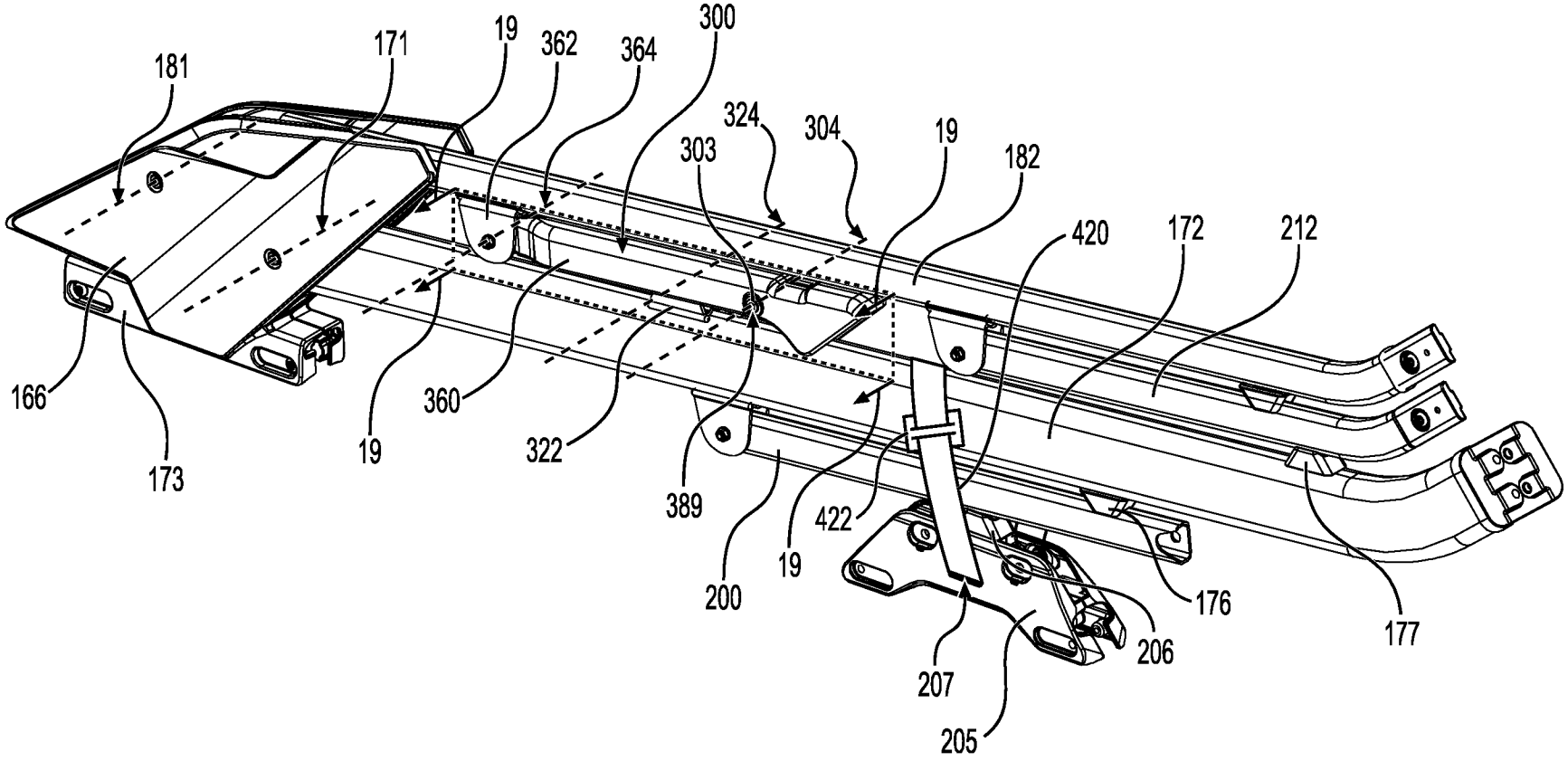
FIG. 18 is a perspective view taken from a top, front, right side of a portion of the bimini of FIG. 3 in a collapsed configuration, the tensioner being in a collapsed and unlocked position.
Figure 19:
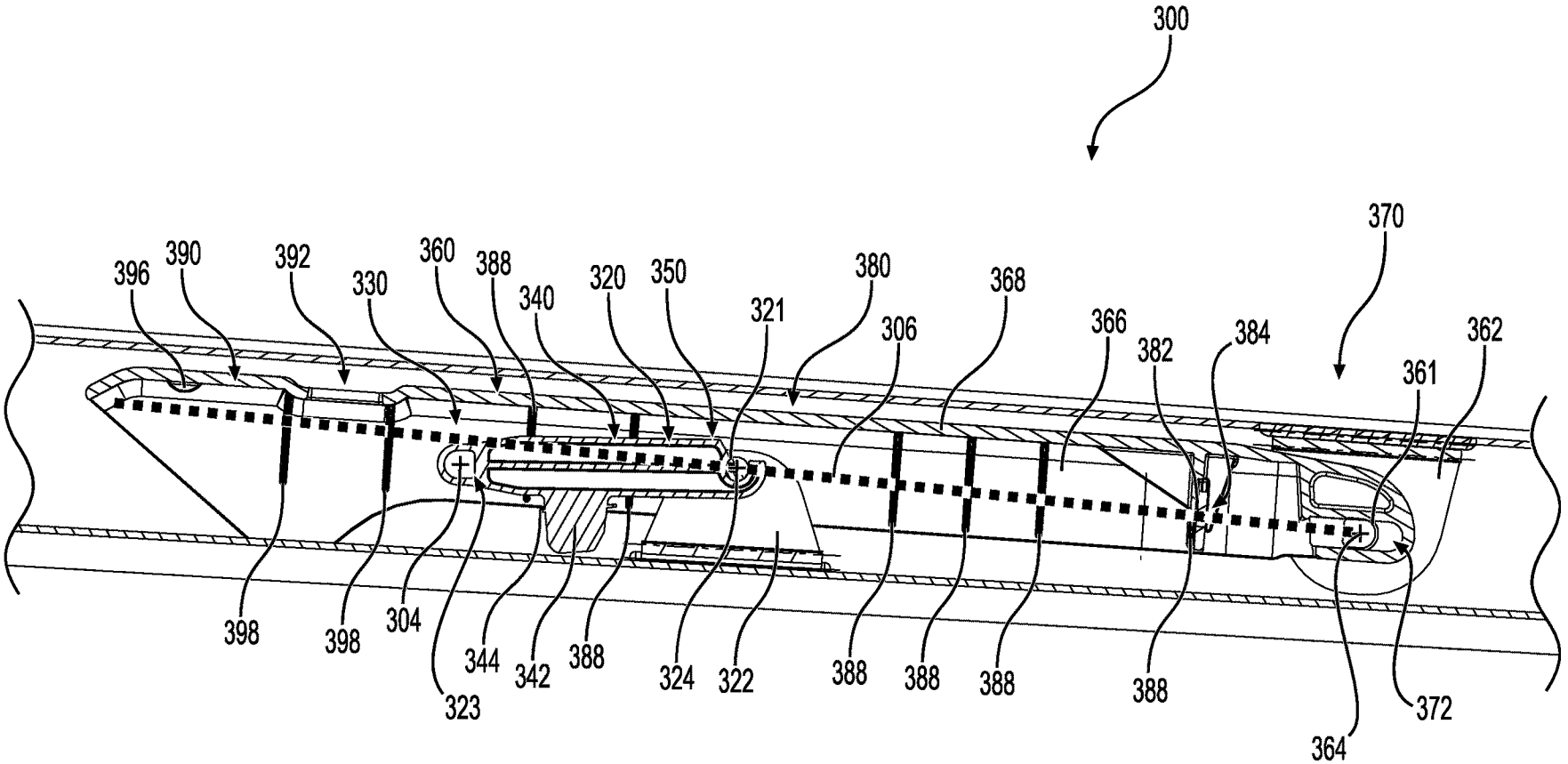
FIG. 19 is a cross-sectional view of the tensioner of FIG. 18, taken along the plane 19-19 of FIG. 18.

Referring to FIGS. 18 and 19, in the collapsed unlocked position, the front pivot axis 324 is between the intermediate pivot axis 304 and the rear pivot axis 364, and the intermediate pivot axis 304 is below the plane 306. When the tensioner 300 is in the collapsed unlocked position, the collapsible frame 160 can be moved from the collapsed configuration to the extended configuration.

Referring to FIGS. 13 and 17, the tension adjuster 400 will now be described in greater detail. When the tensioner 300 is in the locked position (FIG. 13), the tensioner adjuster 400 is operable to adjust the distance between the front and rear pivot axes 324, 364, thereby adjusting the tension provided by the tensioner 300.

The tension adjuster 400 includes the bolt 402. It is contemplated that in other embodiments, the bolt 402 could be an eccentric rotating member, a pivoting member or another translating member. The bolt 402 is connected to the rear arm 360. More precisely, the bolt 402 is received in the aperture 384 such that the threaded surface 404 of the bolt 402 engages the threaded surface 386 of the connecting member 382. It is contemplated that in other embodiments, the bolt 402 could be connected to the rear arm 360 differently. The bolt 402 abuts the pivot member 361, which as mentioned above, defines the rear pivot axis 364. In response to a translational movement of the bolt 402 toward the pivot member 361, the bolt 402 pushes the pivot member 361 so as to make the pivot member 361 move relative to the rear arm 360 along the slot 372 away from the front arm 320, which results in an increase in the distance between the front and rear pivot axes 324, 364, thus increasing the tension provided by the tensioner 300. On the other hand, in response to a translational movement of the bolt 402 away from the pivot member 361, the pivot member 361 can move relative to the rear arm 360 along the slot 372 toward the front arm 320, which results in a decrease in the distance between the front and rear pivot axes 324, 364, thus decreasing the tension provided by the tensioner 300.

Referring back to FIGS. 1 and 5 to 8, the bimini 150, with the collapsible frame 160 in the extended configuration, will now be described in greater detail.

In the extended configuration of the collapsible frame 160, the support 170 extends toward the front side of the boat 50 at an angle to the barrier structure 100. The cavity frame 190 is generally parallel to the deck 60. The orientation and the shape of the cavity frame 190 helps to reduce drag caused by the bimini 150. The stabilizers 200 are connected to their respective brackets 205, which provides stability to the front support 170. The rear support 180, on the other hand, extends toward the rear side of the boat 50 at an angle to the barrier structure 100. The intermediate support 210 extends upwardly and generally parallel to the front support 170.

The top 250 is taut between the front support 170 and the rear support 180. The rear top portion 254 is connected to the top member 184 of the rear support 180. The orientation of the top member 184, helps to retain the top 250 connected thereto. The intermediate support 210 provides support to the top 250 between the front and rear supports 170, 180 as the top portion 254 extends from the rear support 180 to the front support 170.

The tensioners 300 are connected between the supports 170, 180 such that the intermediate pivot axis 304 is between the front pivot axis 324 and the rear pivot axis 364. The tensioners 300 are locked in the locked position. As explained above the tensioners 300 can also be in the intermediate unlocked position when the collapsible frame 160 is in the extended configuration. In the locked position, the tensioners 300 prevent the rear support 180 from pivoting substantially relative to the front support 170 about the pivot axis 181, thereby preventing the collapsible frame 160 to move from the extended configuration to the collapsed configuration. As described above, when the tensioners 300 are in the locked position, the tension adjusters 400 can be operated to ensure that the tension provided by the tensioners 300 keeps the top 250 taut in the extended configuration.

It is contemplated that the orientation of the bimini 150 could be reversed such that the cavity 256 would be at the rear of the bimini 150.

Figure 2:
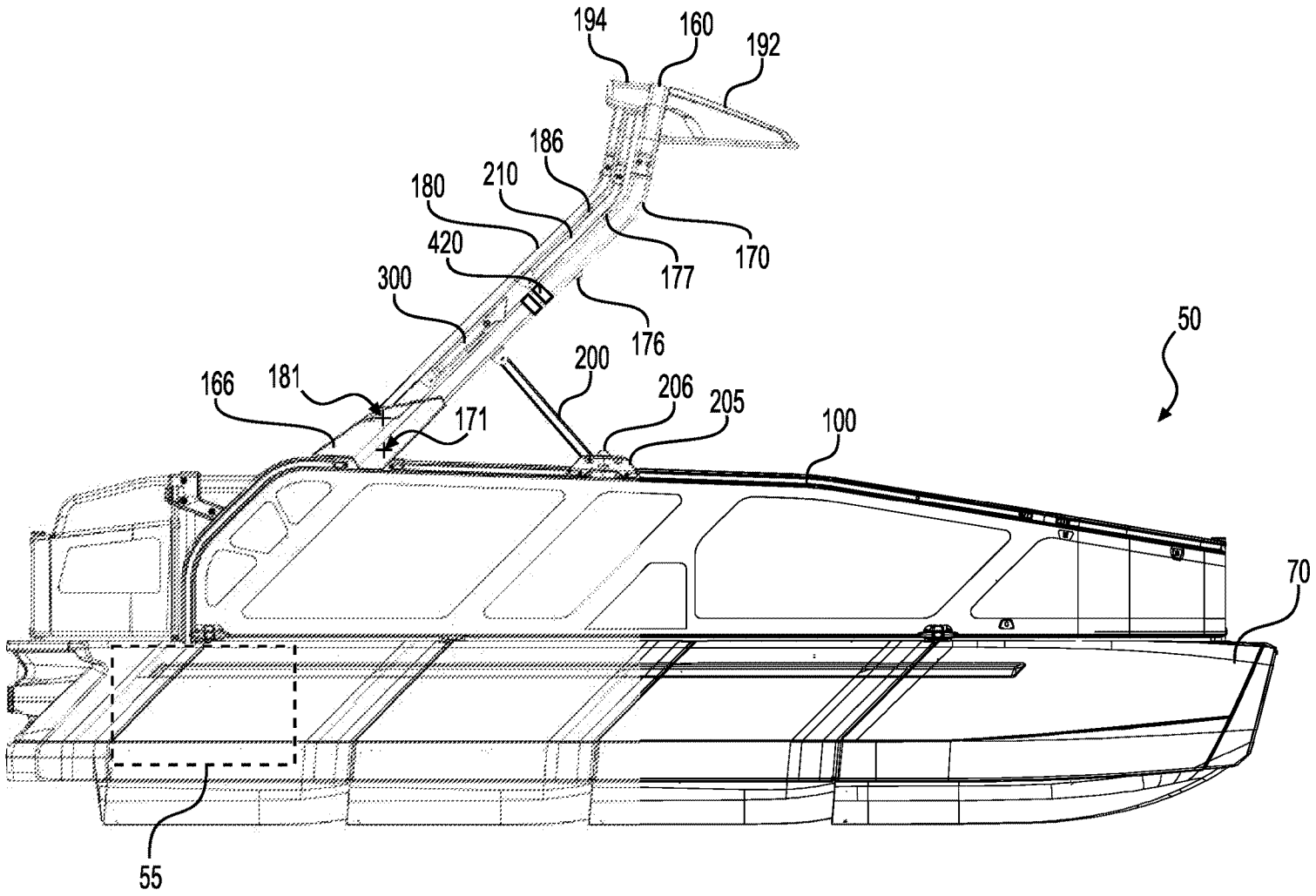
FIG. 2 is a right side elevation view of the boat of FIG. 1 with the bimini in an upright position, the collapsible frame in a collapsed configuration and the tensioners being in a collapsed unlocked position, the top of the bimini being omitted.

Referring to FIGS. 1 and 2, the manner in which the collapsible frame 160 is moved from the extended configuration to the collapsed configuration will now be described.

The tensioners 300 are first moved from the locked position to the intermediate unlocked position by disengaging the lock 310, and moving the rear arm 360 to move the intermediate pivot axis 304 above the plane 306, as described above. As the tensioners 300 are in the intermediate unlocked position, the rear support 180 can now pivot relative to the front support 170 about the pivot axis 181. The rear support 180 is then pivoted about the pivot axis 181 toward the front support 170. The intermediate support 210 is pivoted about the pivot axis 211 toward the rear support 180. The rear support 180 is pivoted until the intermediate support 210 contacts both the bumpers 186 and the bumpers 177. In this position, the rear support 180 extends between the pivot axis 181 and the cavity frame portion 194. The movement of the supports 180, 210 results in the rear top portion 254 becoming loose, to fold, and to hang beneath the rear support 180 and, therefore, in the portion of the cavity 256 beneath the rear cavity frame portion 194 where it is at least partially protected from the elements. In the present embodiment, the cavity 256 also extends forward of the front support 170, within the front cavity frame portion 192. As such, in the present embodiment, as the collapsible frame 160 reaches the collapsed configuration, the loose rear top portion 254 is stored in the cavity 256 by pushing it inside the forward portion of the cavity 256 defined by the front cavity frame portion 192. It is contemplated that in some embodiments, the rear top portion 254 could only be partially stored in the cavity 256. It is further contemplated that front cavity frame 192 could be omitted and the rear top portion 254 could be stored below the rear cavity frame portion 194.

Still referring to FIG. 2, the bimini 150 with the collapsible frame 160 in the collapsed configuration and with the bimini 150 in the upright position will be described.

The supports 170, 180, 210 are configured to be stackable as can be seen. The tensioners 300 are in the collapsed unlocked position. The rear arms 360 of each of the tensioners 300 are parallel to a portion of the lateral members 172, 182, and the front arms 320 are received in the rear arms 360. To maintain the bimini 150 in the upright position, the stabilizers 200 are connected to their respective brackets 205. The rear top portion 254 is stored in the cavity 256.

In the collapsed configuration, the inner clips 197 are connected to the outer clips 257 to retain the collapsible frame 160 in the collapsed configuration and to retain the rear top portion 254 in the cavity 256. In some embodiments, such as embodiments where the front cavity frame portion 192 is omitted and the rear top portion 254 is stored below the rear cavity frame portion 194 in the collapsed configuration, the inner clips 197 are connected to the outer clips 257 to retain a portion of the top 250 below the rear cavity frame portion 194. In the present embodiment, this is accomplished by wrapping the rear top portion 254 around itself such that the portion of the rear top portion 254 where the outer clips 257 are located is inserted in the cavity 256, or is located near the cavity 256, to connect the outer clips 257 to the inner clips 197. In embodiments where the outer clips 257 are disposed on the top portion 252, the straps of the inner clips 197 are long enough to wrap around the rear support 180 before connecting the inner clips 197 to the outer clips 257.

Figure 10:
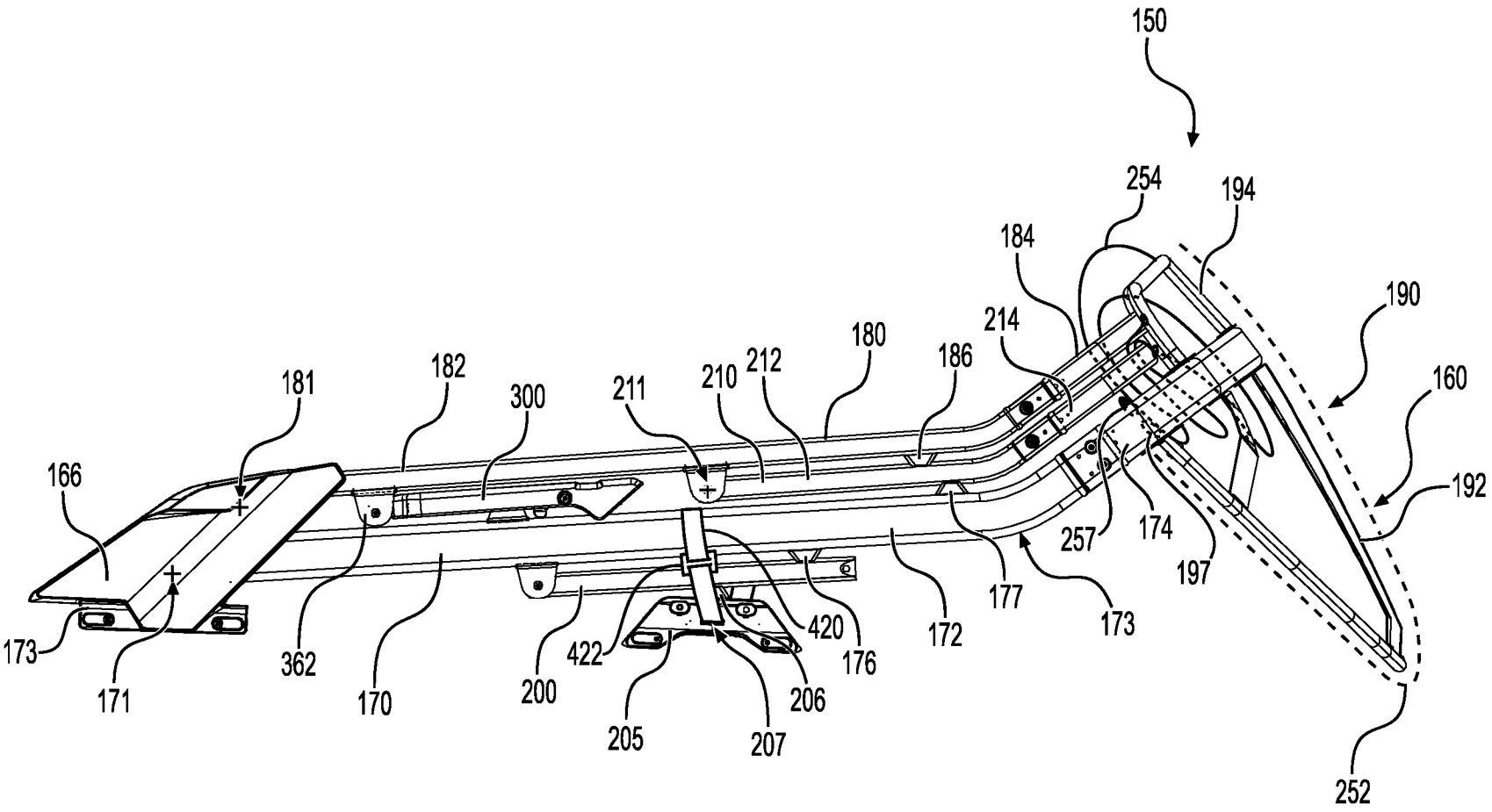
FIG. 10 is a right side elevation view of the bimini of FIG. 3, the bimini being in the stowed position with the top being schematically shown.

When the collapsible frame 160 is in the collapsed configuration, and the stabilizers 200 are disconnected from their brackets 205, the bimini 150 can be pivoted with respect to the barrier structure 100 from the upright position to the stowed position, until the stabilizers 200 are in contact with the bumpers 176 and 206 as shown in FIG. 10. The bimini 150 pivots toward a bow of the boat 50 when the bimini 150 is pivoted from the upright position to the stowed position. It is contemplated that in some embodiments, the bimini 150 could pivot from the upright position to the stowed position toward the stern of the boat 50. Then, with regard to the holding straps 420, as described above, the ends having the hook and loop fasteners can be received through the apertures 207 of their corresponding brackets 205, can then be received through their corresponding buckles 422, and can then connect to themselves, thereby holding the bimini 150 in the stowed position.

Figure 3:
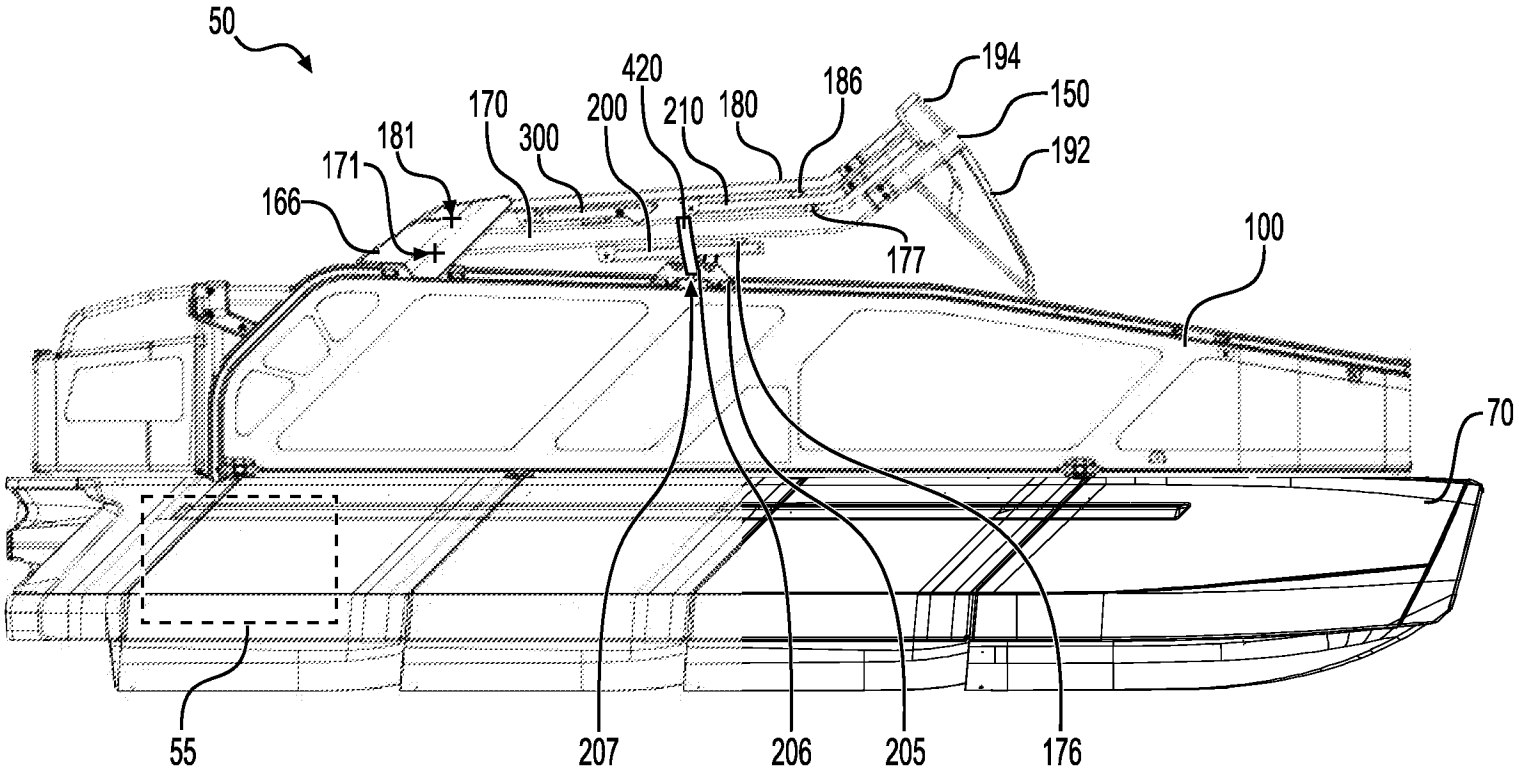
FIG. 3 is a right side elevation view of the boat of FIG. 1 with the bimini in the stowed position, the collapsible frame in the collapsed configuration and the tensioners being in the collapsed unlocked position, the top of the bimini being omitted.

To return the bimini 150 from the stowed position shown in FIG. 3 to the upright position with the collapsible frame 160 in the extended configuration shown in FIG. 1, the above steps are performed in the reverse order.

Modifications and improvements to the above-described embodiments of the present technology may become apparent to those skilled in the art. The foregoing description is intended to be exemplary rather than limiting. The scope of the present technology is therefore intended to be limited solely by the appended claims.

What is claimed is:

1. A bimini comprising:

a collapsible frame selectively movable between a collapsed configuration and an extended configuration, the collapsible frame including:

a first support; and a second support selectively pivotable relative to the first support about a first pivot axis, a top extending between the first support and the second support;

a tensioner connected between the first support and the second support, the tensioner having at least a locked position and an unlocked position, the tensioner comprising:

a first arm pivotally connected to the first support about a second pivot axis, and a second arm pivotally connected to the second support about a third pivot axis and pivotally connected to the first arm about a fourth pivot axis, in the extended configuration of the collapsible frame and in the unlocked position of the tensioner, the fourth pivot axis being on a first side of a plane containing the second and third pivot axes, and the second support being pivotable relative to the first support about the first pivot axis;

in the extended configuration of the collapsible frame and in the locked position of the tensioner, the fourth pivot axis being on a second side of the plane containing the second and third pivot axes, and the second support being prevented from pivoting substantially relative to the first support about the first pivot axis for preventing the collapsible frame to move from the extended configuration to the collapsed configuration; and a tension adjuster being operable to adjust a distance between the second and third pivot axes in the locked position of the tensioner.

2. The bimini of claim 1, wherein one of the first and second arms defines a slot, a corresponding one of the second and third pivot axes of the one of the first and second arms being movable along the slot.

3. The bimini of claim 2, wherein the one of the first and second arms defining the slot is the second arm.

4. The bimini of claim 1, wherein the tension adjuster includes a translating member connected to one of the first and second arms, the translating member abutting a pivot member defining the corresponding one of the second and third pivot axes of the one of the first and second arms, and wherein translation of the translating member moves the pivot member relative to the one of the first and second arms to which the translating member is connected.

5. The bimini of claim 4, wherein the translating member has a threaded surface engaging a corresponding threaded surface of the one of the first and second arms.

6. The bimini of claim 5, where the translating member is a bolt.

7. The bimini of claim 1, wherein the tensioner further includes a lock selectively locking the tensioner in the locked position.

8. The bimini of claim 7, wherein the lock includes a tab extending from one of the first and second arms, the tab selectively hooking onto an other one of the first and second arms to lock the tensioner in the locked position.

9. The bimini of claim 1, wherein one of the first and second arms has lateral members projecting downwardly, the lateral members preventing access to an other of the one of the first and second arms in the unlocked position.

10. The bimini of claim 1, wherein one of the first and second arms substantially covers an other one of the first and second arms.

11. The bimini of claim 1, wherein in the locked position, the second arm extends between the second and third pivot axes and the first arm extends between the third and fourth pivot axes.

12. The bimini of claim 1, wherein in the collapsed configuration of the collapsible frame, the second arm is substantially parallel to a portion of at least one of the first and second supports.

13. The bimini of claim 1, wherein in the collapsed configuration of the collapsible frame, the first arm is received in the second arm.

14. The bimini of claim 1, wherein in the collapsed configuration of the collapsible frame, the second, third and fourth pivot axes are between the first and second supports.

15. The bimini of claim 1, wherein:

the unlocked position is a first unlocked position;

the unlocked position having a second unlocked position;

in the extended configuration of the collapsible frame and in the locked position of the tensioner, the fourth pivot axis is between the second and third pivot axes;

in the extended configuration of the collapsible frame and in the first unlocked position of the tensioner, the fourth pivot axis is between the second and third pivot axes; and in the collapsed configuration of the collapsible frame and in the second unlocked position of the tensioner, the second pivot axis is between the third and fourth pivot axes and the fourth pivot axis is on the second side of the plane containing the second and third pivot axes.

16. A watercraft comprising:

a hull;

a deck disposed on the hull; and a bimini according to claim 1, the bimini being connected to the deck.

17. The watercraft of claim 16, wherein the first support is pivotally connected relative to the deck about a fifth pivot axis.

18. The watercraft of claim 17, wherein:

the first support is pivotally connected to a side structure of the watercraft about the fifth pivot axis, and in the collapsed configuration of the collapsible frame, the bimini selectively pivots with respect to the side structure between a generally upright position to a stowed position.

19. The watercraft of claim 18, further comprising at least one stabilizer bar connected between the first support and the side structure in the extended configuration of the collapsible frame.

20. The watercraft of claim 16, wherein:

in the collapsed configuration of the collapsible frame, the bimini selectively pivots with respect to the deck between a generally upright position and a stowed position.

* * * * *